US009743500B2

(12) United States Patent
Dietz et al.

(10) Patent No.: US 9,743,500 B2
(45) Date of Patent: Aug. 22, 2017

(54) MULTI-VIEW ARCHITECTURAL LIGHTING SYSTEM

(71) Applicant: Misapplied Sciences, Inc., Redmond, WA (US)

(72) Inventors: Paul Henry Dietz, Redmond, WA (US); Albert Han Ng, Redmond, WA (US); David Steven Thompson, Redmond, WA (US)

(73) Assignee: MISAPPLIED SCIENCES, INC., Redmond, WA (US)

( * ) Notice: Subject to any disclaimer, the term of this patent is extended or adjusted under 35 U.S.C. 154(b) by 0 days.

(21) Appl. No.: 15/180,341

(22) Filed: Jun. 13, 2016

(65) Prior Publication Data

US 2016/0366749 A1 Dec. 15, 2016

Related U.S. Application Data

(60) Provisional application No. 62/174,476, filed on Jun. 11, 2015.

(51) Int. Cl.
*H05B 37/02* (2006.01)
*F21V 33/00* (2006.01)
(Continued)

(52) U.S. Cl.
CPC ..... *H05B 37/029* (2013.01); *B44F 1/00* (2013.01); *F21V 33/006* (2013.01); *G09F 19/14* (2013.01);
(Continued)

(58) Field of Classification Search
CPC ..... H05B 33/0815; H05B 37/029; H05B 37/0245; H05B 37/0281
(Continued)

(56) References Cited

U.S. PATENT DOCUMENTS 5,855,425 A 1/1999 Hamagishi
6,339,421 B1 1/2002 Puckeridge
(Continued)

FOREIGN PATENT DOCUMENTS

EP 2685735 A1 1/2014
WO 0224470 A 3/2002
WO 2013183108 A1 12/2013

OTHER PUBLICATIONS

Authorized Officer: Jacinta Molloy, "International Search Report and Written Opinion" dated Sep. 29, 2016 in PCT Application No. PCT/US2016/037185.
(Continued)

*Primary Examiner* — Tung X Le
(74) *Attorney, Agent, or Firm* — Kaplan Breyer Schwarz, LLP

(57) ABSTRACT

A multi-view architectural lighting (MVAL) system includes one or more multi-view lighting units ("MV lights") in which the apparent brightness and color of each MV light is individually and simultaneously controllable for different viewing angles. The MV lights can be pointed in arbitrary directions and installed in arbitrary locations in 3D space with respect to one another, consistent with the structure of a building, etc. This enables a lighting designer to create differentiated lighting experiences for different viewers based on their viewing angle with respect to the MV lights. A calibration system maps viewing locations to emitted light directions for each MV light. Using this information, the appearance of each MV light from a given viewing location relative to that MV light is set by adjusting the light (e.g., typically color and intensity, etc.) emitted in the corresponding direction/directions.

26 Claims, 18 Drawing Sheets

(51) Int. Cl.

| | |
|---|---|
| ***B44F 1/00*** | (2006.01) |
| ***G09F 19/14*** | (2006.01) |
| ***H05B 35/00*** | (2006.01) |
| ***G09F 19/22*** | (2006.01) |
| *F21W 101/02* | (2006.01) |
| *F21W 121/00* | (2006.01) |

(52) U.S. Cl.
CPC ..... *G09F 19/226* (2013.01); *H05B 35/00* (2013.01); *H05B 37/0245* (2013.01); *H05B 37/0281* (2013.01); *F21W 2101/02* (2013.01); *F21W 2121/004* (2013.01)

(58) Field of Classification Search
USPC ..... 315/186, 192, 294, 312
See application file for complete search history.

(56) References Cited

U.S. PATENT DOCUMENTS

| | | | | |
|---|---|---|---|---|
| 7,602,395 | B1 | 10/2009 | Diard | |
| 7,990,498 | B2 | 8/2011 | Hong | |
| 8,461,995 | B1 | 6/2013 | Thornton | |
| 9,080,279 | B2 | 7/2015 | Jun et al. | |
| 2003/0115096 | A1 | 6/2003 | Reynolds et al. | |
| 2003/0156260 | A1 | 8/2003 | Putilin et al. | |
| 2005/0195330 | A1 | 9/2005 | Zacks et al. | |
| 2009/0273486 | A1 | 11/2009 | Sitbon | |
| 2010/0085517 | A1 | 4/2010 | Hong | |
| 2010/0207961 | A1 | 8/2010 | Zomet | |
| 2010/0214537 | A1 | 8/2010 | Thomas | |
| 2011/0159929 | A1 | 6/2011 | Karaoguz et al. | |
| 2011/0216171 | A1 | 9/2011 | Barre et al. | |
| 2011/0242298 | A1 | 10/2011 | Bathiche et al. | |
| 2011/0304613 | A1 | 12/2011 | Thoresson | |
| 2012/0026157 | A1 | 2/2012 | Unkel et al. | |
| 2012/0105445 | A1 | 5/2012 | Sakai et al. | |
| 2012/0218253 | A1 | 8/2012 | Clavin | |
| 2013/0093752 | A1 | 4/2013 | Yuan | |
| 2013/0114019 | A1 | 5/2013 | Ijzerman et al. | |
| 2014/0015829 | A1 | 1/2014 | Park et al. | |
| 2014/0111101 | A1* | 4/2014 | McRae ..... | H05B 33/0806 315/186 |
| 2015/0020135 | A1 | 1/2015 | Frusina et al. | |
| 2015/0042771 | A1 | 2/2015 | Jensen et al. | |
| 2015/0049176 | A1 | 2/2015 | Hinnen et al. | |
| 2015/0062314 | A1 | 3/2015 | Itoh | |
| 2015/0198940 | A1 | 7/2015 | Hwang et al. | |
| 2015/0334807 | A1* | 11/2015 | Gordin ..... | H05B 37/0218 315/152 |
| 2016/0012726 | A1 | 1/2016 | Wang | |
| 2016/0210100 | A1 | 7/2016 | Ng et al. | |
| 2016/0212417 | A1 | 7/2016 | Ng et al. | |
| 2016/0224122 | A1 | 8/2016 | Dietz et al. | |
| 2016/0227201 | A1 | 8/2016 | Ng et al. | |
| 2016/0261837 | A1 | 9/2016 | Thompson et al. | |
| 2016/0261856 | A1 | 9/2016 | Ng et al. | |
| 2016/0293003 | A1 | 10/2016 | Ng et al. | |
| 2016/0341375 | A1* | 11/2016 | Baker ..... | F21V 21/02 |
| 2016/0341377 | A1* | 11/2016 | Eddins ..... | F21V 31/005 |
| 2016/0371866 | A1 | 12/2016 | Ng et al. | |

OTHER PUBLICATIONS

"Office Action" dated Oct. 6, 2016 in U.S. Appl. No. 15/060,527.
Officer: Patricia Stein, "International Search Report and Written Opinion", dated Jun. 3, 2016, issued in related PCT Application: PCT/US2016/04122.
Officer: Patricia Stein, "International Search Report and Written Opinion", dated May 12, 2016, issued in related PCT Application: PCT/US2016/020784.
"Non-Final Office Action", U.S. Appl. No. 15/002,158, dated Mar. 3, 2017, p. 19.
Authorized Officer: Mehrdad Dastouri, "International Preliminary Report on Patentability" dated Feb. 3, 2017 issued in PCT International Application PCT/US16/14122, 21 pp.
"Non-Final Office Action", dated Mar. 22, 2017, Issued in related U.S. Appl. No. 15/002,164, 28 pp.
Officer: Jeffrey Harold, "International Preliminary Report on Patentability", dated Mar. 20, 2017, Issued in International Patent Application PCT/U52016/020784, 6 pp.
"Non-Final Office Action", dated Mar. 24, 2017, Issued in related U.S. Appl. No. 15/002,175, 26 pp.
"Non-Final Office Action", Related U.S. Appl. No. 15/184,874, dated May 22, 2017, 19 pp.
"Non-Final Office Action", Related U.S. Appl. No. 15/015,099, dated May 4, 2017, 9 pp.
"Non-Final Office Action", dated Jan. 26, 2017, issued in U.S. Appl. No. 15/088,912.

* cited by examiner

MULTI-VIEW ARCHITECTURAL LIGHTING SYSTEM

CROSS REFERENCE TO RELATED APPLICATIONS

This case claims priority to U.S. patent application Ser. No. 62/174,476, filed Jun. 11, 2015, which is incorporated by reference herein.

FIELD OF THE INVENTION

The present invention relates to architectural lighting.

BACKGROUND

Architectural lighting is designed to serve both practical and aesthetic goals. Lighting designers use natural light and a wide variety of illumination devices and surface finishes to achieve desired effects. For example, strings of lights are frequently employed to frame the edges of a building. With modern LED-based fixtures, it is easy to control brightness as well as color. For more exotic effects, video projectors can be employed to project dynamic images onto surfaces.

Current architectural lighting fixtures fall into one of two groups: direct view or indirect view. As the name implies, direct-view lighting is viewed directly by a viewer; that is, the viewer views the light source. Most direct-view lighting is designed to transmit light fairly uniformly in all directions. An example of direct-view lighting is a string of holiday lights. With indirect-view lighting, the viewer generally does not directly view the light source; rather, the viewer views light that has been scattered off a surface or passed through a diffusing material.

There is at least one significant limitation as to what can be achieved with either of the aforementioned lighting systems. Namely, any and all viewers that view the lighting effect at the same time share the same lighting experience. There is little ability to create different lighting experiences for different viewers.

In particular, consider direct view lighting. Although there might be different color bulbs in the string, any given light bulb in the string appears to be substantially the same color and brightness independent of a viewer's location with respect to the bulb. Likewise, with indirect-view lighting, the scattered or diffused light appears relatively uniform regardless of the location of the viewer.

SUMMARY

Embodiments of the invention provide a lighting system and method that overcomes the aforementioned drawback of conventional lighting systems. In accordance with the illustrative embodiment, a multi-view architectural lighting (MVAL) system includes one or more multi-view lighting units ("MV lights") in which the apparent brightness and color of each lighting unit is individually and simultaneously controllable for different viewing angles. This enables a lighting designer to create differentiated lighting experiences for different viewers. For example, a particular passerby might see a building outlined in rippling red and white lights, while others on the street at a different location (i.e., at a different viewing angle with respect to the lighting) might see it glowing with steady green lights, all at the same time.

An MV light can be designed to have the capability to emit light in millions of different directions. And the MVAL system is capable of individually and simultaneously controlling the light (e.g., on/off, color, intensity, etc.) emitted in all such directions, such that the light emitted in all such directions can differ. Most applications will not require such extreme resolution; an MV light designed (or operated) to controllably provide "different" light simultaneously in a much smaller number of different directions is sometimes sufficient.

The MVAL system is calibrated to its environment; the plural emitted light directions for each MV light are mapped to viewing locations in a viewing region of the MVAL system. Using this information, a system controller is able to control the appearance of each MV light from a given viewing location. That is, viewers in different viewing locations can simultaneously see different selected colors and brightness coming from the same MV lights within the MVAL system. Or the same light(s) can appear to be "on" in one viewing location and "off" in another viewing location. Consequently, viewers in different locations can simultaneous experience different lighting patterns/lighting shows from the same group of MV lights.

There are many use applications for the MVAL system disclosed herein. For example, the MVAL system can be installed on a building or sky scraper to provide differentiated lighting content (lighting patterns, lighting shows, symbols, etc.) to: pedestrians at different locations, pedestrian traffic versus vehicular traffic, passengers in two different aircraft, etc. Or the MVAL system can be installed on a theme/amusement park attractions. In some embodiments, a visitor to the theme park can trigger the delivery of lighting content. In some embodiments, only the visitor triggering the system and those nearby can see the content; others outside of that "viewing zone" will be not be able to see the lighting content. A viewer can trigger the system by accomplishing one or more tasks (e.g., waving a "magic wand" or appropriately brandishing some other fanciful device, completing a series of physical challenges, etc.).

In some further embodiments, the MVAL system is installed on a structure that moves. In such embodiments, the MVAL can be operated to deliver lighting content, in proper sequence, to viewers in different locations. And in yet some further embodiments, an MVAL system can used in an interior (of a building, etc.) to simultaneously direct multiple visitors to different locations within the interior. These are but a few of the many applications for embodiments of MVAL systems disclosed herein.

In some embodiments, a multi-view architectural lighting system comprises: a controller and a plurality of multi-view lights that are controlled by the controller, wherein:

(A) each multi-view light consists of a single multi-view pixel, wherein the multi-view pixel is capable of generating a plurality of beamlets, each of which has a different emission direction from other of the beamlets of the plurality;

(B) a placement of each multi-view light with respect to a placement of each other multi-view light is not constrained to a plane or otherwise limited;

(C) at least some beamlets of the plurality thereof are selectively generated and emitted under the control of the controller so that, simultaneously and from the same plurality of multi-view lights:

(i) a first lighting pattern generated by at least some of the selectively generated beamlets is perceivable at a first viewing zone of a viewing region;

(ii) one of either:

(a) a second lighting pattern generated by at least some other of the selectively generated beamlets is perceivable at a second viewing zone of the viewing region; or (b) no lighting pattern is perceivable at the second viewing zone because beamlets having an emission direction for causing a lighting pattern to be perceivable in the second viewing zone are not generated;

(iii) the first viewing zone and the second viewing zone have a different viewing angle from one another with respect to the multi-view lights; and (iv) the second lighting pattern is not perceivable at the first viewing zone and the first lighting pattern is not perceivable at the second viewing zone.

A further aspect of the invention is a method for using architectural lighting, wherein the method comprises:

positioning a plurality of multi-view lights in arbitrary locations in 3D space with respect to one another as a function of a structure on which the multi-view lights are installed and in accordance with a lighting plan; and simultaneously selectively generating and emitting beamlets from at least some of the multi-view lights, so that:

(i) a first lighting pattern generated by at least some of the selectively generated beamlets is perceivable at a first viewing zone of a viewing region;

(ii) one of either:

(a) a second lighting pattern generated by at least some other of the selectively generated beamlets is perceivable at a second viewing zone of the viewing region; or (b) no lighting pattern is perceivable at the second viewing zone because beamlets having an emission direction for causing a lighting pattern to be perceivable in the second viewing zone are not generated;

(iii) the first lighting pattern, the second lighting pattern, and said no lighting pattern are generated by the same multi-view lights;

(iv) the first viewing zone and the second viewing zone have a different viewing angle from one another with respect to the multi-view lights; and (v) the second lighting pattern is not perceivable at the first viewing zone and the first lighting pattern is not perceivable at the second viewing zone.

DETAILED DESCRIPTION

Figure 1A:
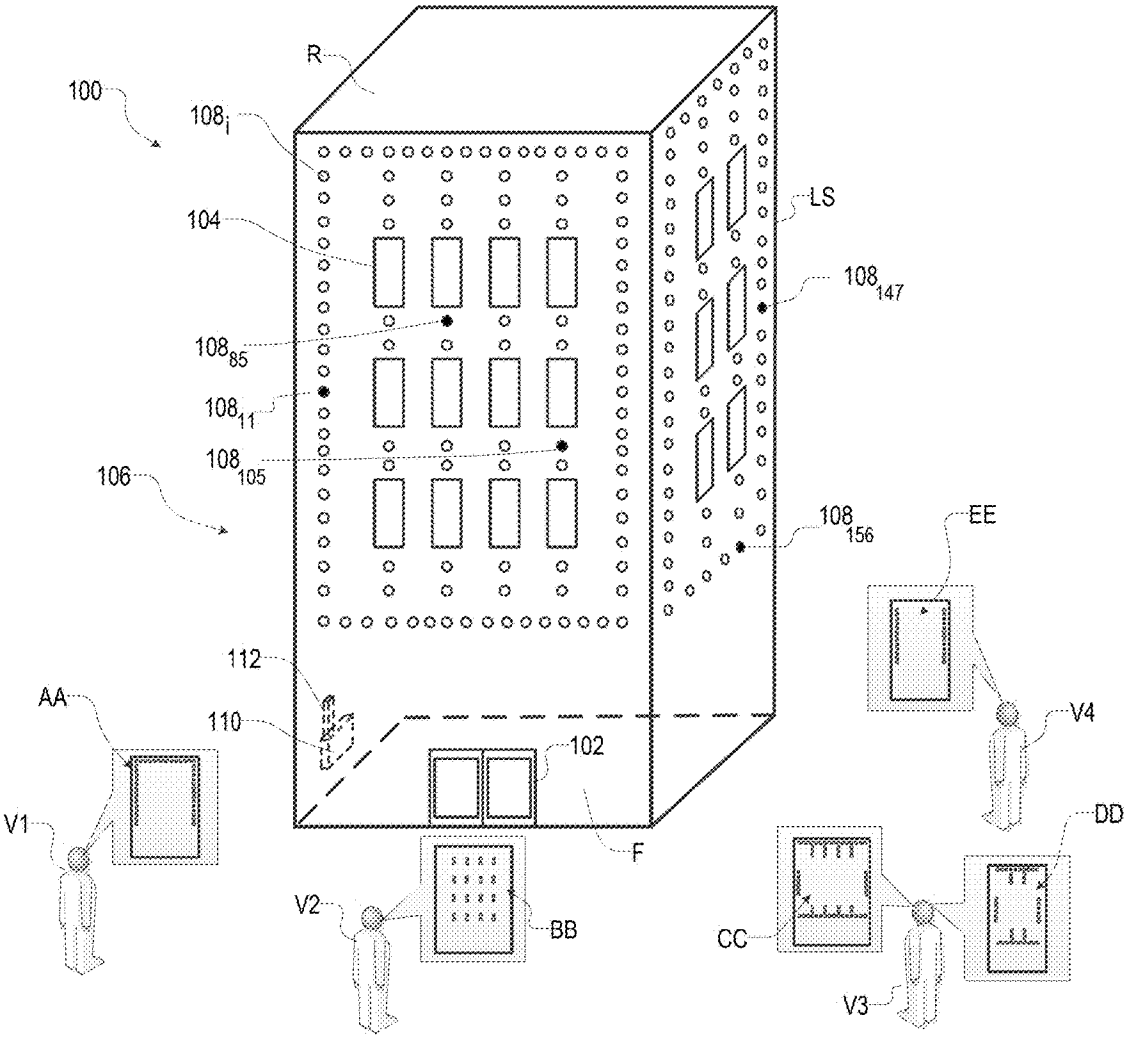
FIG. 1A depicts a building having an MVAL system in accordance with the illustrative embodiment of the present invention.

FIG. 1A depicts building 100 having multi-view architectural lighting ("MVAL") system 106 in accordance with the illustrative embodiment of the present invention. Building 100 itself is of conventional design and includes at least one set of doors 102 and a plurality of windows 104. Front F, left side LS, and roof R of building 100 are visible in FIG. 1A.

MVAL system 106 includes a plurality of multi-view ("MV") lights $\mathbf{108}_i$, where i=1, n, wherein n can be any positive integer. The MV lights (hereinafter collectively referenced "MV lights 108") are sited at different locations on the exterior of building 100 in accordance with a layout developed by, for example, a lighting designer. MVAL system 106 also includes controller 110 and cable(s) 112 for supplying data for calibrating and/or operating the system, at least some of which is generated by the controller, and power to MV lights 108. For clarity, the connections between cable(s) 112 and MV lights 108 are not depicted. In some embodiments, power-over Ethernet is used to send power and data to each MV light $\mathbf{108}_i$ in MVAL system 106. This enables the use, in MVAL system 106, of standard networking gear and a single cable (carrying both power and data) to each MV light $\mathbf{108}_i$. In some other embodiments, power and data are sent over different cables and different data and/or power delivery schemes are used.

As described in further detail later in this disclosure in conjunction with FIGS. 2 and 3, each MV light $\mathbf{108}_i$ is able to emit different light in a number of different directions. The light emitted in each such direction is referred to as a "beamlet." Thus, each MV light 108; is a source of a plurality of individually controllable beamlets of light, wherein the beamlets are emitted in a different direction than other of the beamlets emitted from the MV light and wherein the beamlets:

(i) are the same color as other beamlets emitted from the MV light, or (ii) are a different color than at least some of the other beamlets emitted from the MV light, (iii) are the same intensity as other beamlets emitted from the MV light, or (iv) are a different intensity as at least some other of the beamlets emitted from the MV light, (v) are any combination of (i) through (iv), or (vi) differ from at least some other beamlets emitted from the MV light in terms of characteristics other than, or in addition to, color and/or intensity per item (v).

For example, an MV light might be capable of emitting a beamlet of blue light in a first direction, emitting a beamlet of green light in a second direction, emitting a beamlet of purple light in a third direction, and so forth. Those beamlets might all have the same intensity or one or more of the beamlets might vary in intensity from one another. This is in marked contrast to a conventional light, which emits a particular color light in all directions of emission. As discussed later in this disclosure, the number of directions in which an individual MV light can emit light is a function of its design. Current designs by the inventors emit light in about 500,000 different directions and the next generation version is expected to emit light in millions of directions. Of course, MV lights can be designed to emit light in far fewer directions (i.e., two or more directions), as is suitable for the particular architectural-lighting application.

Figure 5:
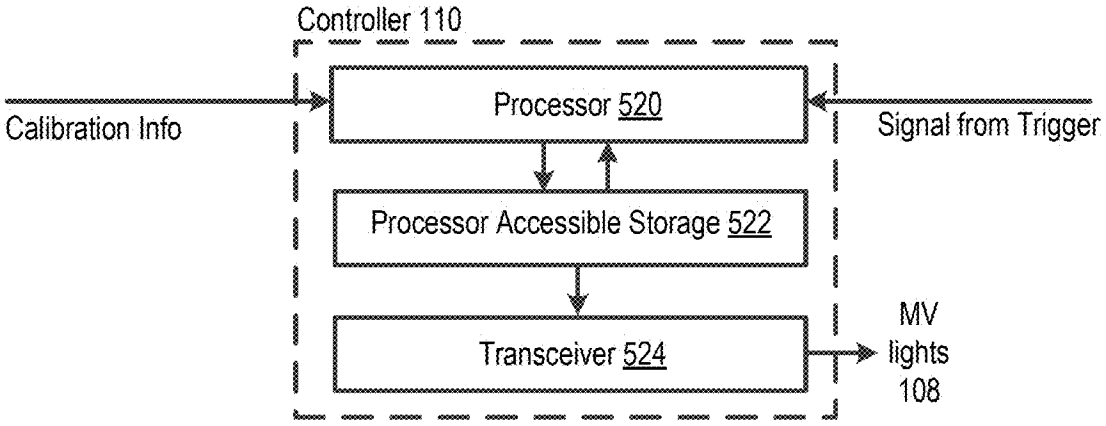
FIG. 5 depicts an embodiment of a controller of an MVAL system.

Controller 110, depicted in FIG. 5, provides several functions, including, without limitation:

(1) generating some or all of the data required for individually controlling each MV light $\mathbf{108}_i$ to generate beamlets, as appropriate, to display different lighting content to different viewing locations;

(2) generating, storing, and/or processing data, either on its own or in conjunction with auxiliary equipment, to calibrate MVAL system 106;

(3) responding to an externally sourced command to display lighting content; and (4) receiving sensor input as to where to display lighting content.

Controller 110 includes processor 520, processor-accessible storage 522, and transceiver 524. Processor 520 is a general-purpose processor that is capable of, among other tasks, executing an operating system, executing device drivers, and executing specialized application software used in conjunction with the embodiments of the invention. Processor 520 is also capable of populating, updating, using, and managing data in processor-accessible data storage 522. In some alternative embodiments of the present invention, processor 520 is a special-purpose processor. It will be clear to those skilled in the art how to make and use processor 520.

Processor-accessible data storage 522 is non-volatile, non-transitory memory technology (e.g., RAM, ROM, EPROM, EEPROM, hard drive(s), flash drive(s) or other solid state memory technology, CD-ROM, DVD, etc.) that stores, among any other information, data, device drivers (e.g., for controlling MV lights 108, etc.), and specialized application software, which, when executed, enable processor 520 and MV lights 108 to perform as disclosed herein. It will be clear to those skilled in the art how to make and use processor-accessible data storage 522.

Transceiver 524 enables one or two-way communications with input/locating devices and/or other devices and systems via any appropriate medium, including wireline and/or wireless, and via any appropriate protocol (e.g., Bluetooth, Wi-Fi, cellular, optical, ultrasound, etc.). The term "transceiver" is meant to include any communications means and, as appropriate, various supporting equipment, such as communications ports, antennas, etc. It will be clear to those skilled in the art, after reading this specification, how to make and use transceiver 524.

In some further embodiments, the storage and processing functionality of the controller is performed, in significant part, remotely (e.g., cloud computing, etc.). For example, in some embodiments, controller 110 includes a boot loader that wakes up and downloads the necessary software and data from one or more remote servers via a network into volatile memory of the controller. Those skilled in the art will know how to implement such other implementations of controller 110.

With continued reference to FIG. 1A, four viewers V1, V2, V3, and V4 are simultaneously observing building 100 at night. Viewers V1 and V2 have a view of front F of building 100, viewer V3 has a view of front F and left side LS of building 100, and viewer V4 has a view of left side LS of building 100. MVAL system 106 is activated.

As depicted in FIG. 1A, each of the four viewers sees rather different lighting content (in this case, different lighting patterns), even though building 100 is being viewed simultaneously by all of the viewers. In particular, viewer V1 sees lighting pattern AA, viewer V2 sees lighting pattern BB, viewer V3 sees lighting pattern CC on front F of the building and lighting pattern DD on left side LS of the building, and viewer V4 sees lighting pattern EE. The patterns AA through EE are enlarged for clarity in FIGS. 1B through 1E, respectively.

Figure 1B:
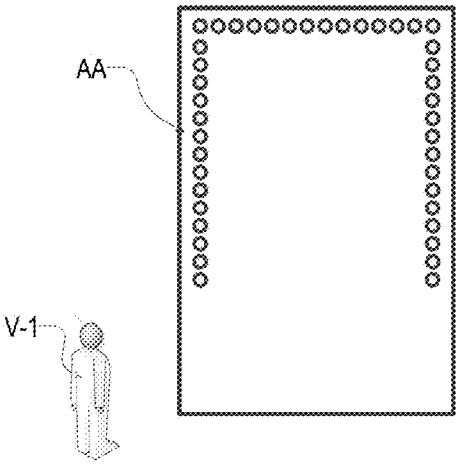
FIG. 1B depicts viewer V1's view of the building of FIG. 1A when its MVAL system is illuminated.
Figure 1C:
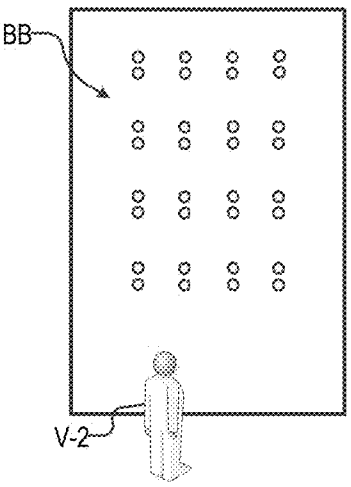
FIG. 1C depicts viewer V2's view of the building of FIG. 1A when its MVAL system is illuminated.

Per FIG. 1B it appears to viewer V1 that only the MV lights along the perimeter of front F of the building are illuminated, thereby defining the inverted "u" arrangement of lighting pattern AA. Viewer V2 perceives only the pairs of MV lights 108 above and below the windows to be illuminated, defining lighting pattern BB as depicted in FIG. 1C.

Figure 1D:
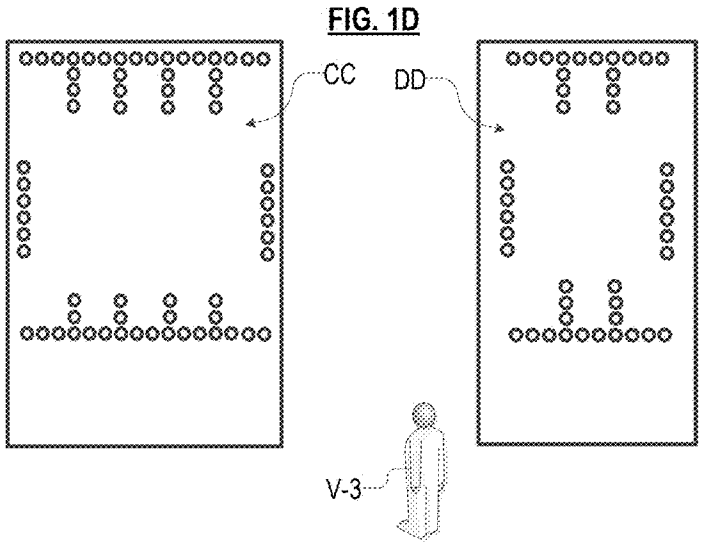
FIG. 1D depicts viewer V3's view of the front of the building and the side of the building of FIG. 1A when its MVAL system is illuminated.

Lighting pattern CC, shown in FIG. 1D, as seen by viewer V3 when looking at front F of building 100, is very different from what is seen by either viewer V1 or V2. In particular, in lighting pattern CC, the uppermost and lowermost rows of MV lights 108 appear to viewer V3 to be illuminated, as well as MV lights 108 contiguous therewith located directly above the top row of windows and below the bottom row of windows, as well as the central portion of the leftmost and rightmost column of MV lights. Viewer V3 sees lighting pattern DD on left side LS of building 100. Lighting pattern DD is similar to lighting pattern CC, but scaled for the smaller dimensions of the left side of the building relative to the front of building 100.

Figure 1E:
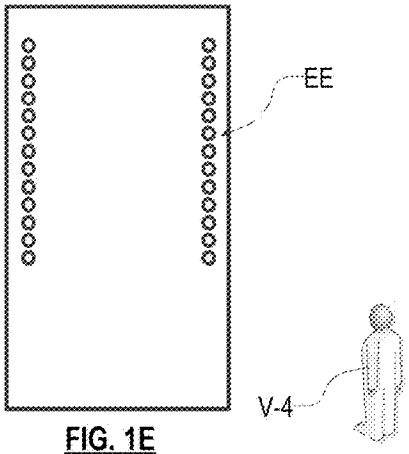
FIG. 1E depicts viewer V4's view of the side of the building of FIG. 1A when its MVAL system is illuminated.

Viewer V4 sees lighting pattern EE, depicted in FIG. 1E, which is different from the lighting patterns viewed by the other viewers. In particular, viewer V4 sees only the MV lights 108 sited along the left and right perimeter of left side LS of the building as being illuminated.

In addition to the different patterns AA through EE created by (what appears to the viewers as) selective illumination of certain MV lights 108, the color of the light in one or more of the lighting patterns could be different from that of one or more of the other lighting patterns. Furthermore, a given lighting pattern need not be monochromatic. And lighting patterns can be dynamic, alternatively turning "on" and "off," or appearing to change in other ways. It is worth noting that, in order for an MV light to be visible from a given viewing location, there must be a beamlet from that light that illuminates that particular viewing location.

The MV light. The capability of MVAL system 106 to display, simultaneously, different lighting content to different viewers is a consequence of the aforementioned ability of each MV light 108; to controllably emit beamlets of light in different directions. An embodiment of MV light $\mathbf{108}_i$, identified as MV light $\mathbf{208}_i$, is depicted in FIG. 2.

In this embodiment, MV light $\mathbf{208}_i$ is projector-based and includes 256 conventional pixels $\mathbf{214}_j$ arranged in a 16×16 array 215. In other embodiments, the MV light can include less than or more than 256 conventional pixels. In fact, a current implementation includes about 500,000 conventional pixels and some next generation embodiments will include millions of pixels.

As indicated, MV light $\mathbf{208}_i$ can be implemented using a projector, such as a "pico-projector;" and any suitable projection technology (e.g., LCD, DLP, LCOS, etc.) can be used. Pico-projectors are commercially available from Texas Instruments, Inc. of Dallas, Tex. and others. Briefly, a pico-projector includes an LED light source; collection optics, which direct the light from the LED to an imager; an imager, typically a DMD (digital micromirror device) or an LCOS (liquid-crystal-on-silicon) device, which accepts digital-display signals to shutter the LED light and direct it to the projection optics; output or projection optics, which project the display image on the screen and also permit functions such as focusing of the screen image; and control electronics, including the LED drivers, interfacing circuits, and the video and graphics processor. See, e.g., http://www.embedded.com/print/4371210. In some embodiments, off-the-shelf pico-projectors are modified, for example, to reduce brightness compared with conventional projection applications.

Figure 2:
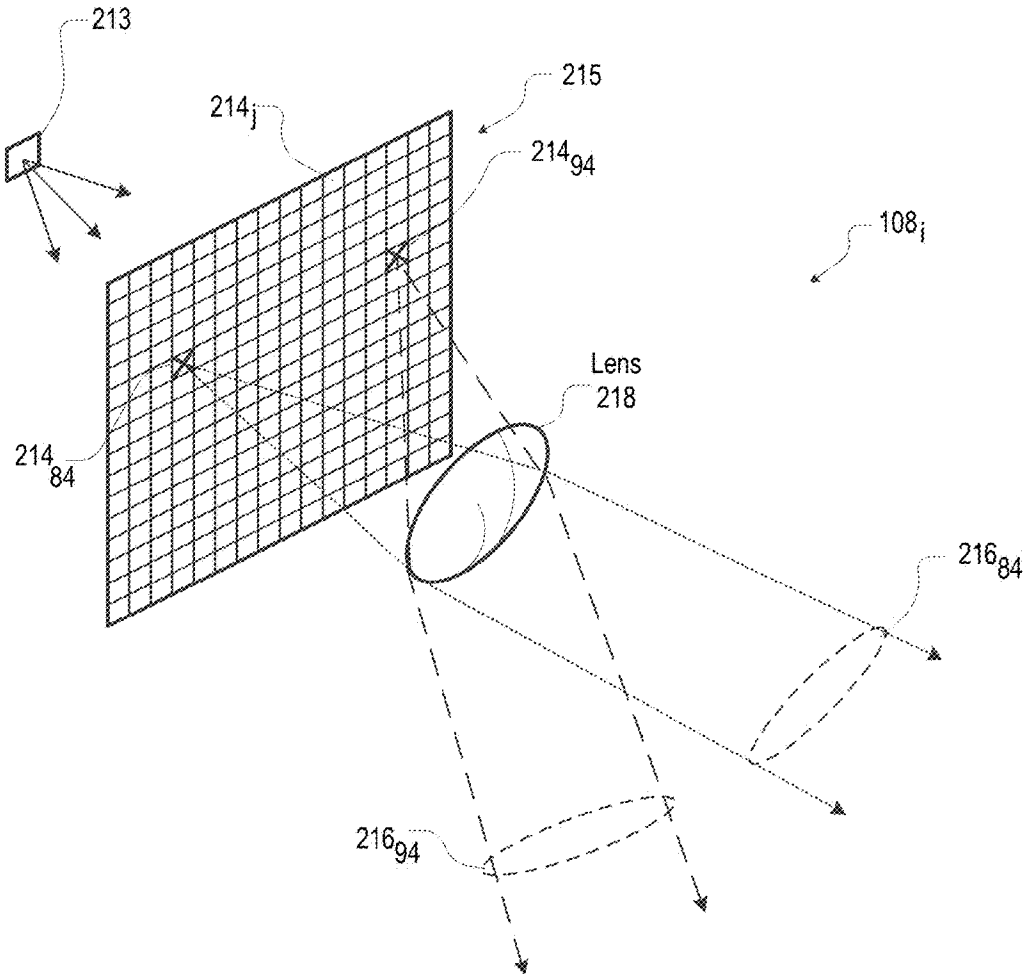
FIG. 2 depicts an embodiment of an MV light of the MVAL system of FIG. 1A.

FIG. 2 presents a greatly simplified representation of projector operation, focusing on the aspects that are germane to an understanding of the present invention. Light, such as from light source 213, is directed toward pixel array 215 (e.g., the DMD or LCOS device, etc.). Although light source 213 is depicted as being located behind pixel array 215, in some other embodiments, the light source is disposed in front of pixel array 215, as a function of the projector technology.

The array of conventional pixels $\mathbf{214}_j$, in combination with lens 218, defines a "multi-view pixel" capable of generating a plurality of beamlets, each with a unique emission direction. See, U.S. patent application Ser. No. 15/002,014 (US Pat Pub 20160212417). Thus, MV light $\mathbf{208}_i$ with its 256 conventional pixels is capable of generating 256 beamlets.

More particularly, when one or more selected pixels are activated by controller 110 (FIGS. 1A and 5), the light impinging on such pixels is directed (via reflection or transmission) toward lens 218, which generates beamlet $\mathbf{216}_j$ from the received light. Consider, for example, conventional pixels $\mathbf{214}_{84}$ and $\mathbf{214}_{94}$. When activated, conventional pixel $\mathbf{214}_{84}$ directs the light it receives toward lens 218. That light propagates from pixel $\mathbf{214}_{84}$ in all directions. Lens 218 collects a sizable fraction of that light and collimates it into beamlet $\mathbf{216}_{84}$. Similarly, when conventional pixel $\mathbf{214}_{94}$ is activated, it directs the light it receives toward lens 218. That light propagates from pixel $\mathbf{214}_{94}$ in all directions, a sizeable fraction of which is collected by lens 218 and collimated into beamlet $\mathbf{216}_{94}$. By virtue of the fact that conventional pixels $\mathbf{214}_{84}$ and $\mathbf{214}_{94}$ have a different angular orientation (in 1 or 2 directions) with respect to lens 218, the emission directions of respective beamlets $\mathbf{216}_{84}$ and $\mathbf{216}_{84}$ will differ from one another.

If, for example, pixel $\mathbf{214}_{84}$ passes blue light when activated, then a viewer whose eyes receive beamlet $\mathbf{216}_{84}$ will see a blue "dot." If pixel $\mathbf{214}_{94}$ passes red light when activated, then a viewer whose eyes receive beamlet $\mathbf{216}_{94}$ will see a red "dot." The size/appearance of the "dot" can vary in size and shape based on the operation of lens 218.

As previously indicated, by virtue of its two hundred and fifty six multi-view pixels, MV light $\mathbf{208}_i$ depicted in FIG. 2 is able to emit as many as 256 different beamlets. Each beamlet $\mathbf{216}_j$ can be a different color and/or intensity from some or all of the other pixels of the same MV light and each will have a different emission direction. Furthermore, the beamlets can differ from one another in other properties of light (e.g., spectral composition, polarization, beamlet shape, beamlet profile, overlap with other beamlets, focus, spatial coherence, and temporal coherence).

Figure 3:
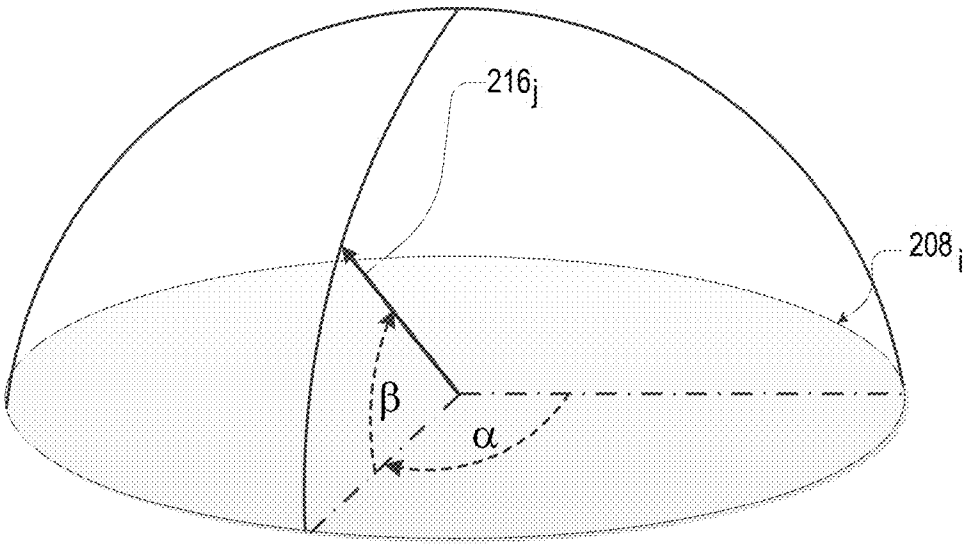
FIG. 3 depicts an orientation of a beamlet emitted from the MV light of FIG. 2.

As depicted in FIG. 3, the emission direction of beamlet $\mathbf{216}_j$ can be characterized by two angles, such as azimuth $\alpha$ and altitude $\beta$. It is notable that although beamlets are depicted in the accompanying figures as simple lines with an arrowhead indicating their direction of emission, they can have an angular extent and can be any shape. For this reason, characterizing the beamlet using the aforementioned two angles is necessarily an approximation. For example, and without limitation, beamlets might have a shape similar to the beam from a searchlight, but typically smaller. Furthermore, the conventional pixels that compose each MV light can be arranged in a circular pattern, a quadrilateral pattern, or any other convenient arrangement.

It will be appreciated from the foregoing discussion that some embodiments of the MV light are known in the art (such as when based on a pico-projector). A key difference, however, when used in the context of the MVAL systems disclosed herein, is the manner in which the pico-projector, for example, is operated. In particular, the emission direction of each conventional pixel is determined and mapped to the environment of the MVAL system so that, in conjunction with the controller's ability to independently address each conventional pixel and control characteristics of the beamlet associated with each such pixel, different lighting content (e.g., patterns, shows, information, etc.) can be simultaneously displayed (from the same MV lights) to different viewing zones.

A further important feature of embodiments of the invention is that the MV lights of the MVAL system can be arranged by an installer in arbitrary physical configurations, yet still share, through the operation of the controller, a common understanding of the location of viewing zones so that desired lighting content is achieved with a single integrated system. This distinguishes the MVAL system, for example, from multi-view displays disclosed by applicant (see, e.g., U.S. pat. application Ser. No. 15/002,014). In particular, such multi-view displays comprise a plurality of multi-view pixels, which are: typically constrained to a planar arrangement, point in the same direction, and are all visible from any viewing location. In such multi-view displays, the multi-view pixels are configured, at the time of manufacture, in a specific arrangement. By contrast, each MV light $\mathbf{108}_i$ defines a single multi-view pixel. In an MVAL system, each multi-view pixel (each MV light) will be individually sited at arbitrary location and with an arbitrary direction with respect to other MV lights. Thus, the multi-view pixels of an MVAL system need not constrained to a planar arrangement, do not necessarily point in the same direction, and often are not all visible from any viewing location. Furthermore, in an MVAL system, the user (lighting designer, etc.) rather than the manufacturer, determines the arrangement of multi-view pixels with respect to one another.

In many (but not necessarily all) MVAL installations, the MV lights are separated from one another by a distance that is greater than the resolving power of the human eye as viewed from intended viewing zones. As such, each MV light is distinctly resolved by a viewer. By contrast, in a multi-view display, each multi-view pixel is typically located very close to one another (sub-millimeter spacing) so that individual multi-view pixels cannot be separately resolved. The limit of resolution of the human eye is typically considered to be in the range of about 1 to 2 arc minutes. As such, in some embodiments, the MV lights of an installed MVAL system will be separated by a minimum of about 1 arc minute, as viewed from the intended viewing zones. Typically, but not necessarily, the multi-view pixels (i.e., each MV light) will be spaced at least 10 centimeters apart and often 0.5 meters or more apart from one another.

As previously noted, in the illustrative embodiment, MV light $\mathbf{108}_i$ is projector based. In some other embodiments, MV light $\mathbf{108}_i$ is not projector based; for example, each pixel is itself a light source, i.e., a material that is able to glow, emitting light when electrically excited with an appropriate electrical excitation (e.g., LED, OLED, etc.). These (conventional) pixels can be organized in a planar array. Light from these individually addressable pixels is collects by a lens. The lens collimates the light from a given selectively activated pixel to generate a beamlet. This arrangement defines a multi-view pixel capable of generating a plurality of beamlets each having a different emission direction as a function of the location of the pixel in array. Alternatively, a collection of individual lights (LEDs, spotlights, etc.), each pointing in a different direction and each being individually addressable, are grouped together to form a multi-view pixel. Each individual light generates a beamlet having a different emission direction than other lights in the grouping.

Figure 4:
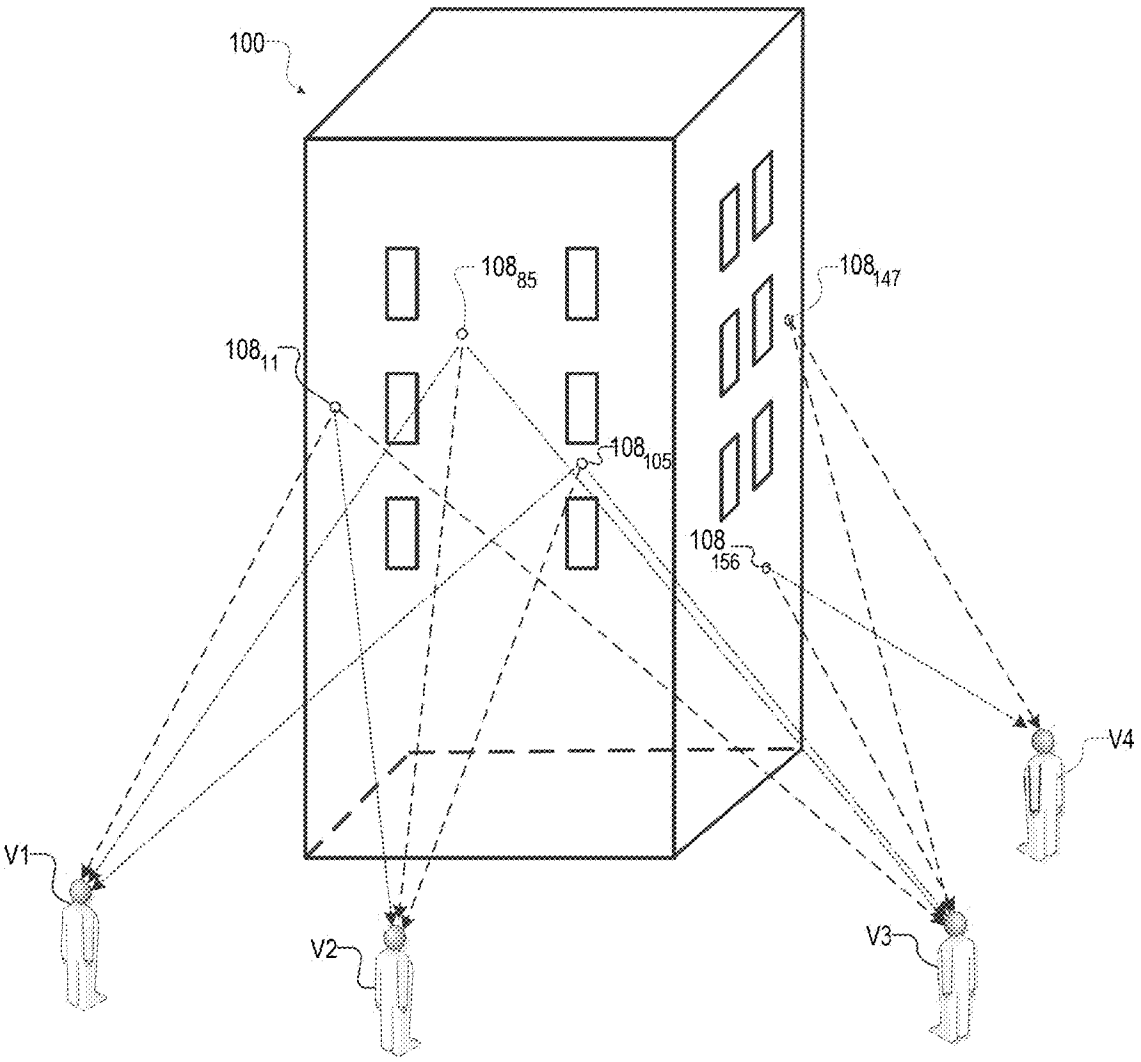
FIG. 4 depicts the state of several MV lights of the MVAL system of FIG. 1A in terms of their contribution to lighting pattern observed by viewers V1 through V4.

The operation of MVAL system 106 depicted in FIG. 1A, and viewers' V1 through V4 experience thereof as depicted in FIGS. 1B through 1F, is now discussed in further detail by examining the operation of several of MV lights 108 of the system. Consider, in particular, the operation of MV lights $\mathbf{108}_{11}$, $\mathbf{108}_{85}$, $\mathbf{108}_{105}$, $\mathbf{108}_{147}$, $\mathbf{108}_{156}$ depicted in FIG. 1A and again in FIG. 4. The latter figure depicts, for the sake of clarity, a simplified view of building 100, MVAL system 106, the subject MV lights, and viewers V1 through V4. A ray tracing shown as a "dashed" line from an MV light indicates a beamlet emitted in the indicated direction. A ray tracing shown as a "dotted" line indicates that no beamlet (no light) is emitted in the indicated direction.

Consider viewer V1. This viewer has a view of front F of building 100 and sees lighting pattern AA (FIG. 1A, FIG. 1B). Consequently, of the three MV lights $\mathbf{108}_{11}$, $\mathbf{108}_{85}$, $\mathbf{108}_{105}$ on front F of the building, only MV light $\mathbf{108}_{11}$ appears to be illuminated. This means that the particular pixel(s) of MV light $\mathbf{108}_{11}$ that generates a beamlet(s) that propagates in a direction that causes the beamlet(s) to reach the eyes of viewer V1 is activated. Conversely, the particular pixel(s) of each of MV lights $\mathbf{108}_{85}$ and $\mathbf{108}_{105}$ that generate a beamlet(s) that propagates in a direction that would otherwise cause it to reach the eyes of viewer V1 are not activated.

Viewer V2, who has a view of front F of building 100, sees lighting pattern BB depicted in FIG. 1C. Consequently, of the three MV lights $\mathbf{108}_{11}$, $\mathbf{108}_{85}$, $\mathbf{108}_{105}$ on front F of the building, MV lights $\mathbf{108}_{85}$ and $\mathbf{108}_{105}$ appear to be illuminated and MV light $\mathbf{108}_{11}$ appears dark. This means that the particular pixel(s) of MV lights $\mathbf{108}_{85}$ and $\mathbf{108}_{105}$ that generates a beamlet(s) that propagates in a direction that causes the beamlet(s) to reach the eyes of viewer V2 are activated. Conversely, the particular pixel(s) of MV lights $\mathbf{108}_{11}$ that generate a beamlet(s) that propagates in a direction that would otherwise cause it to reach the eyes of viewer V1 is not activated.

Viewer V3, who has a view of front F and left side LS of building 100, sees respective lighting patterns CC and DD depicted in FIG. 1D. Consequently, of the three MV lights $\mathbf{108}_{11}$, $\mathbf{108}_{85}$, $\mathbf{108}_{105}$ on front F of the building, MV light $\mathbf{108}_{11}$ appears to be illuminated and MV lights $\mathbf{108}_{85}$ and $\mathbf{108}_{105}$ appear dark. And of the two MV lights $\mathbf{108}_{147}$ and $\mathbf{108}_{156}$ on left side LS of the building, both appear to be illuminated. Thus, the particular pixel(s) of MV lights $\mathbf{108}_{11}$, $\mathbf{108}_{147}$, and $\mathbf{108}_{156}$ that generate a beamlet(s) that propagates in a direction that causes the beamlet(s) to reach the eyes of viewer V3 are activated. And the particular pixel(s) of MV lights $\mathbf{108}_{85}$ and $\mathbf{108}_{105}$ that generate a beamlet(s) that propagates in a direction that would otherwise cause it to reach the eyes of viewer V1 are not activated.

Viewer V4, who has a view of left side LS of building 100, sees lighting pattern EEB depicted in FIG. 1E. As such, of the two MV lights $\mathbf{108}_{147}$ and $\mathbf{108}_{156}$ visible to viewer V4, MV light $\mathbf{108}_{147}$ appears to be illuminated while MV light $\mathbf{108}_{158}$ appears dark. Once again, this means that the particular pixel(s) of MV light $\mathbf{108}_{147}$ that generates a beamlet (s) that propagates in a direction that causes the beamlet(s) to reach the eyes of viewer V4 is activated. And the particular pixel(s) of MV light $\mathbf{108}_{156}$ that generates a beamlet(s) that propagates in a direction that would otherwise cause it to reach the eyes of viewer V4 is not activated.

The foregoing discussion examined the operation of MVAL system 106 in the context of only five of its many lights. It will be understood that this process of illuminating (or not illuminating) pixel(s) of a MV light is performed for every MV light in the MVAL system. For example, from the perspective of viewer V1, only the MV lights along the perimeter of front F of building 100 are illuminated. Therefore, the pixel(s) in each MV light along the perimeter of the building that cause a beamlet to reach viewer V1's eyes are illuminated. And for MV lights that are not located along the perimeter of the building, the pixel(s) in each of those lights that would otherwise cause a beamlet to reach viewer V1's eyes are not illuminated. At the same time, other pixels in perimeter-located MV lights might or might not be illuminated as a function of: (1) the direction in which they emit a beamlet and (2) the particular lighting design. Of course, other pixels of those non-perimeter MV lights might be illuminated to generate other light patterns visible to viewers located in different viewing locations.

Calibration. It will be understood that for MVAL system 106 to display a particular lighting pattern to a viewer at a particular viewing location, specific MV lights $\mathbf{108}_i$ of the MVAL system must emit light to that viewing location. For this to occur, elements (e.g., controller 110, etc.) of MVAL system 106 must know, at a minimum, for each MV light $\mathbf{108}_i$ in the system: (a) the emission direction of each beamlet originating from the multiple pixels $\mathbf{214}_j$ that compose the MV light, and (b) which emission direction(s) illuminate which particular viewing zones. In embodiments in which MVAL system 106 is capable of generating light of more than one color, then MVAL system 106 must also have knowledge of the color of the beamlet generated by each pixel of each MV light. In some embodiments, calibration yields a table of relationships between locations in the viewing region and beamlets.

Calibration of the MVAL system 106, which includes registration to the environment in which it is being used, is accomplished via any one of a variety of techniques. In one technique, the emission direction of each the plural beamlets emitted from the plural pixels is determined by measurements obtained from a calibration device(s) situated in the region—the viewing region—in which viewers will view the lighting. Calibration techniques for a multi-view display are described in U.S. patent application Ser. No. 15/002,014 (U.S. Pat. Pub. 20160212417), which is incorporated herein by reference. The calibration techniques described therein are generally suitable for use with the MVAL systems disclosed herein. It is within the capabilities of those skilled in the art, in light of the referenced disclosure and the present disclosure, to apply the calibration techniques described in Ser. No. 15/002,014 to the MVAL systems discussed herein.

Figure 6:
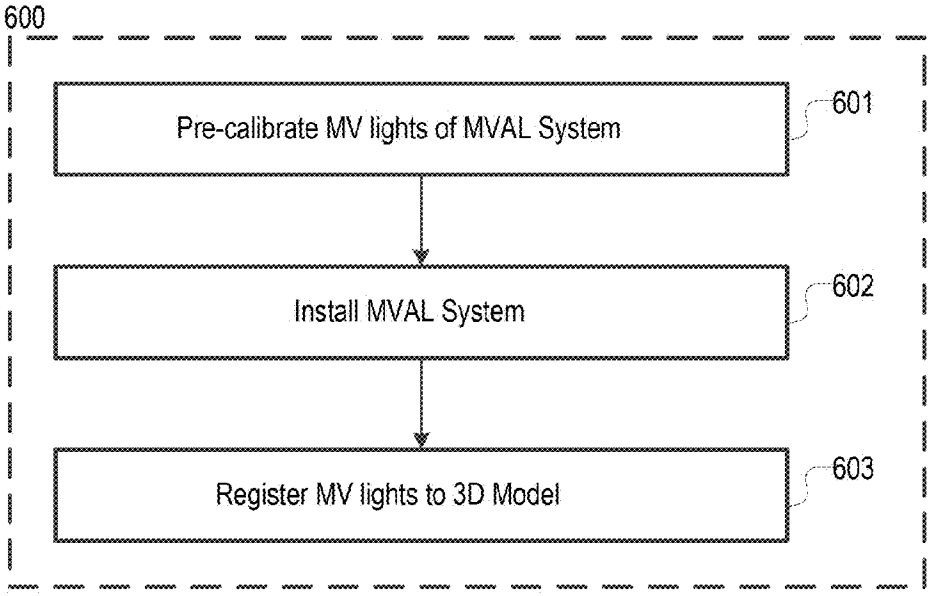
FIG. 6 depicts a method for calibrating an MVAL system and registering it to its environment.

MVAL systems will often be required to work over large distances. For example, it is not uncommon to light skyscrapers so that they may be seen for many miles. In such scenarios, it is typically not practical to perform calibration in the manner referenced above (i.e., moving a calibration device throughout the viewing region to calibrate all viewing locations. Rather, method 600, as depicted in FIG. 6, can be used instead.

Figure 7:
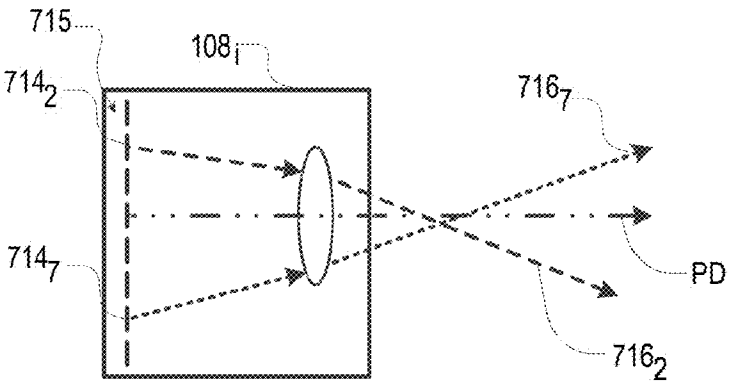
FIG. 7 depicts the pointing direction of an MV light of an MVAL system.

Per task 601 of method 600, MV lights 108 of an MVAL system are "pre-calibrated." In this context, the term "pre-calibrated" means that the lights are calibrated prior to installation, such as during manufacture. This calibration involves determining the emission direction of each beamlet emitted from a given MV light with respect to a pointing direction the MV light. This concept is illustrated in FIG. 7, wherein two beamlets $\mathbf{716}_2$ and $\mathbf{716}_7$ are sourced from respective pixels $\mathbf{714}_2$ and $\mathbf{714}_7$ of MV light 108*i*. These beamlets each have an emission direction characterized by, for example, an azimuth and an altitude, as discussed in conjunction with FIG. 3. It is notable that in FIG. 7, which depicts an MV light via a side view, only altitude β (see FIG. 3) of the beamlets with respect to pointing direction PD is apparent. Once manufacturing is complete, the emission direction of each beamlet emitted from MV light $\mathbf{108}_i$ is fixed with respect to pointing direction PD of that particular MV light. Thus, if the emission direction of a particular beamlet is known with respect to the pointing direction of the MV light, then the pointing direction of the light can be determined.

In task 602, the MVAL system is installed. Since light can be considered to travel in a straight line in air, the pre-calibration information is sufficient to characterize the emission directions of each of the plurality of beamlets emitted from each MV light with respect to the pointing direction of each such MV light. The pointing direction PD of each installed light must be determined so that the MVAL system can be registered to its environment. In some embodiments, this is accomplished using a calibration device, having, for example, a light emitter and a camera. Calibration device 522 can be positioned, for example, at two known locations relative to the known location of the light. One or more beamlets having known emission directions (as determined from pre-calibration) are emitted from each MV light $\mathbf{108}_i$ and received by the camera of the calibration device at known locations in the viewing region. Since each beamlet can be associated with a unique pattern, the information captured by the camera, which is transmitted to controller 110, can uniquely identify the particular beamlet received. Due to the fixed relationship between the emission direction of each beamlet emitted from each MV light and the pointing direction of each such MV light, sufficient information is therefore available (e.g., to controller 110, etc.) to determine the pointing direction of each MV light 108*i*.

In task 603, the MV lights are "registered" to a 3D model of the viewing region. Consider, for example, an MVAL system on a skyscraper, wherein the system is designed so that the look of lighting is different when viewed from each different neighborhood in the city. Thus, each neighborhood is analogous to a viewing zone, as previously discussed. A 3D model of the viewing region (i.e., the city in this scenario), as is often available (e.g., from city officials, etc.), is obtained. The location and pointing direction of each MV light, obtained at tasks 601 and 602, is registered to the 3D model. That is, each MV light is "oriented" in the 3D model. If the location of the MV light in the 3D model is known, obtaining measurements at two locations is suffice to determine the pointing direction of the MV light. If it can be reasonably assumed that the camera is level along the "roll" axis, a measurement at only one location is required. If the position of the camera is not known (in the model), it can be determined by obtaining measurements at more than two locations.

So registered, the "landing spots" for each beamlet from each MV light in the MVAL system can be estimated. In this context, "landing spot" is the estimated location, such as a viewing zone, in which each particular beamlet will "land;" that is, intersect a surface, such as a viewer's eyes. Consequently, the system has the information required to determine which beamlets from which MV lights are viewable from which particular neighborhoods. This information can be used to present different lighting patterns to different viewers located in different neighborhoods.

It will be advantageous for an installer of an MVAL system to dynamically visualize the viewing region so that each MV light can be pointed in the proper direction. To that end, in some embodiments, each MV light $\mathbf{108}_i$ includes an optical sight and a camera, or a mount in which those alignment devices are temporarily attached. The optical sight can be used to help properly point the camera and to perform later alignment tasks. Assuming the camera has a known viewing relationship to the MV light, that relationship can be used to find the landing spots for beamlets using a single picture from the camera. After installation of the lights, the registration procedure can be to take the images obtained by the camera on each MV light, indicate on each image where known locations appear on the images, and then find the corresponding beamlets from the pre-calibration data.

Figure 8A:
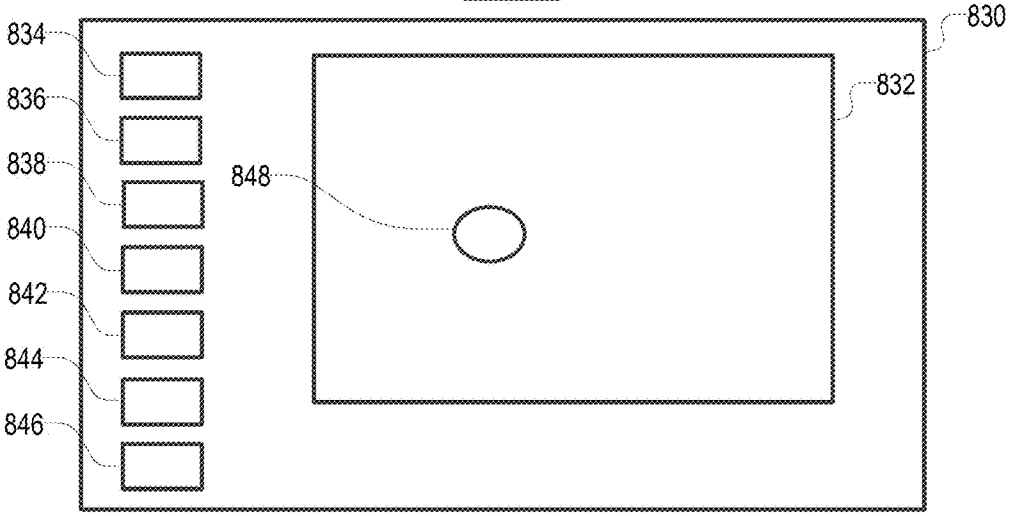
FIG. 8A depicts an illustrative embodiment of a user interface for controlling an MVAL system.

User Interface. FIG. 8A depicts an illustrative embodiment of user interface 830 for controlling MVAL system 106. Via user interface 830, a user can program MVAL system 106 to present a desired lighting effect to a particular viewing zone. The user interface includes a region 832 in which the viewing region for the MVAL system of interest is displayed. The representation of the viewing region can be actual camera footage, a graphical rendering, or any other approach for visually representing a particular viewing zone.

The user establishes a desired viewing zone in the viewing region by pressing "create view" button 834. This causes "viewing zone" 848 to appear in the viewing region. Viewing zone 848 is movable (via a mouse, etc.) within the viewing region and can also be re-shaped and/or re-sized to define and represent the shape and scaled size of a desired viewing zone.

Figure 8B:
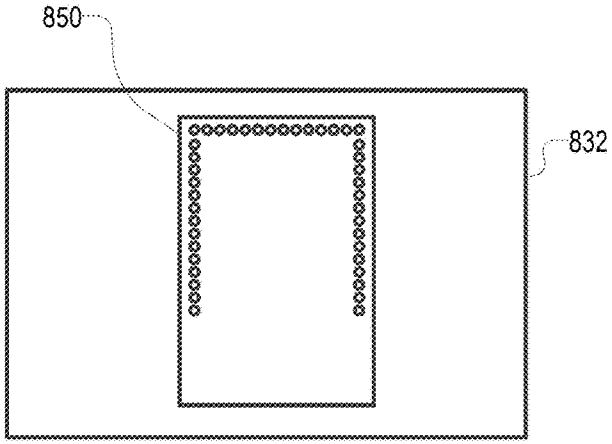
FIG. 8B depicts a lighting pattern selectable via the user interface of FIG. 8A.

Lighting options for viewing zone 848 can be accessed by pressing "lighting" button 836. Successive presses of the lighting button enables a user to view all lighting patterns available for the selected viewing zone. The user selects a desired lighting pattern by, for example, "clicking" on it. FIG. 8B depicts selected lighting pattern 850 in region 832 of user interface 830. Once a particular lighting pattern is selected, "clock" button 844 is pressed. This provides access to a screen (presented in region 832) that enables a user to set a schedule for displaying the selected lighting pattern. In accordance with the schedule, controller 110 generates the selected light pattern by, in part, accessing the calibration table that relates beamlets to locations within the viewing region (i.e., viewing zones).

In the illustrative embodiment, user interface 830 also includes:

- pan/zoom button 838 for enlarging the view of viewing zone 848 and moving within the enlarged viewing zone;
- add button 840 for adding viewing zones (to region 832);
- delete button 842 for deleting viewing zones (from region 832);
- set button 846 for finalizing the user's designation of viewing zone 848 and lighting pattern 850.

It will be appreciated by those skilled in the art that a user interface suitable for use in conjunction with MVAL system 106 can be implemented in many ways other than what is described above. In light of the present disclosure, it is within the capabilities of those skilled in the art to design and implement a user interface for use in conjunction with MVAL system 106.

Applications. There are many ways in which a Multi-View Architectural Lighting system can be used to entertain, inform, direct, or otherwise provide useful benefit.

For example, at dedication ceremonies, it is common to have a person of some importance or note "flip" a switch that lights a building, a bridge, a holiday tree, or other large object. This experience is accompanied by some sense of satisfaction and even a sense of power. Unfortunately, few people ever get to experience this for themselves.

Consider, for example, an iconic structure in a theme park, such as a castle. It would be exciting for a park guest to take some action that causes the castle to light up. This could, of course, be accomplished with conventional lighting systems. However, if any significant number of guests were to have the experience, all guests would see the castle regularly lighting up, which would detract from specialness of the event.

Ideally, the effect of lighting up the castle would only be seen by the person who triggered it and the people immediately in his or her vicinity. This way, the specialness and apparent uniqueness of the event is maintained. Unlike conventional lights, an MVAL system can target the effect to be visible only in the desired area. For example, inserting and turning an appropriate key in a lock might trigger the lighting effect to be visible in the area surrounding the lock.

Figure 9:
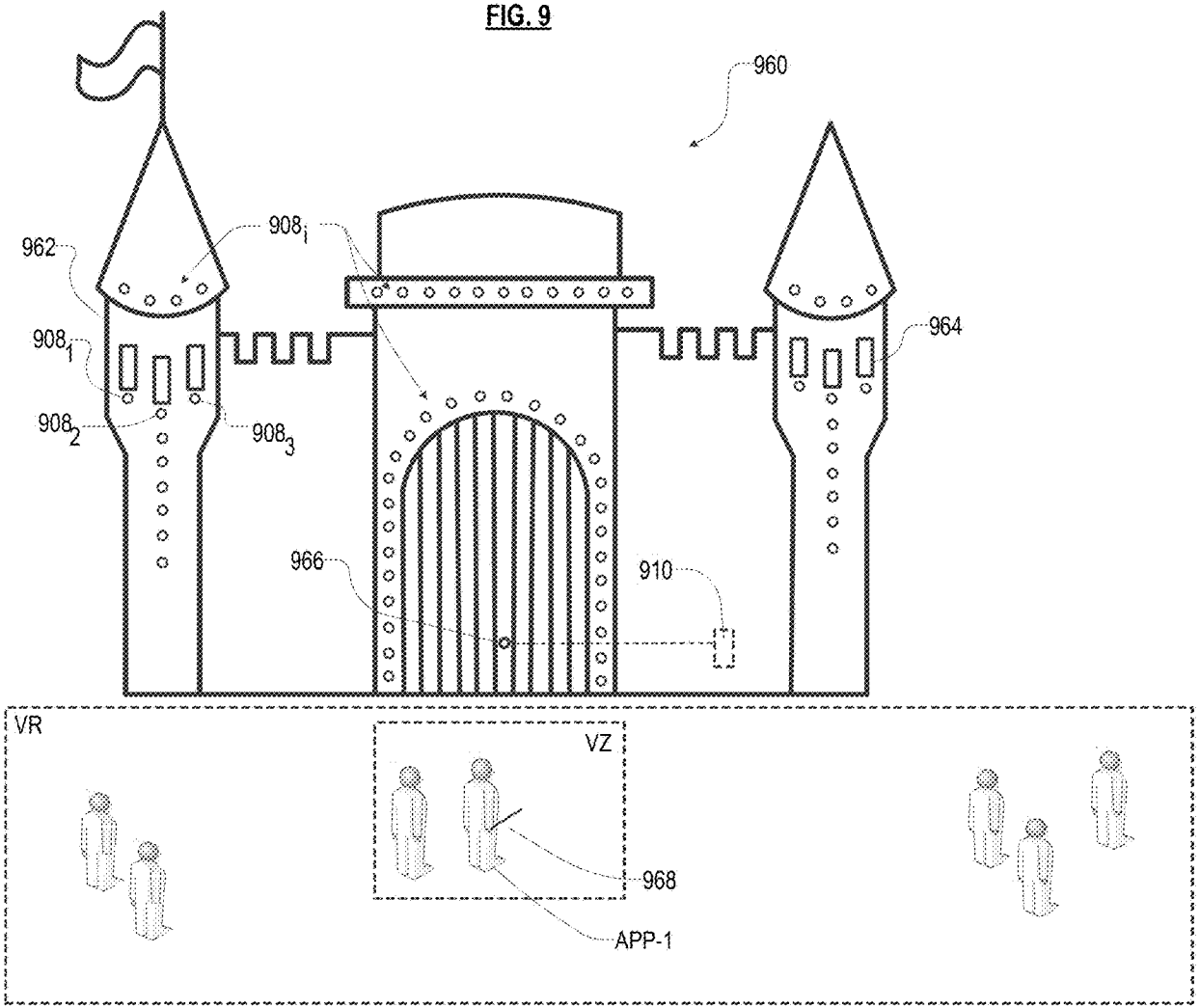
FIG. 9 depicts an embodiment of an MVAL system that is triggered via a viewer's action.

FIG. 9 depicts an illustration of the foregoing "triggered" MVAL experience wherein castle 960 includes an MVAL system having controller 910 and a plurality of MV lights 908. Normally, the only lights on castle 960 that appear lit are MV lights 9081, 9082, and 9083, which are disposed directly beneath windows 964 on turrets 962. These MV lights appear to be lit to any amusement park patron regardless of their location in viewing region VR.

In the embodiment depicted in FIG. 9, the goal of the castle amusement is to trigger the lighting display by waving or pointing "magic wand" 968. Sensor 966, which can be, for example, a camera and image recognition software, light sensor, etc., as appropriate, senses movement or a position of the "magic wand" or a signal emitted therefrom. Once sensed, a signal is generated and/or transmitted by sensor 966 to controller 910, which causes all MV lights 908 (i.e., those on turrets 962, those surrounding the drawbridge, etc.), which are normally "off," to illuminate for a brief period of time (e.g., 10 seconds, etc.). That illumination is, however, only visible to viewers in viewing zone VZ. In this embodiment, amusement park patron AAP-1 must be located in viewing zone VZ when she waves or aims magic wand 968. Consequently, if she triggers the sensor, patron AAP-1 and any companions standing within viewing zone VZ will experience the lighting display. Amusement park patrons standing outside of viewing zone VZ will be unaware of the lighting display experience by those in viewing zone VZ; they will continue to perceive, as illuminated, only the three lights under each window.

It will be appreciated that there are many variants of the scenario depicted in FIG. 9. For example, the MVAL system may be installed on any structure and the triggering device may take any of a variety of forms as is suitable for the particular context (the nature of the amusement). Among other implementations, in some embodiments, the triggering device is a fanciful device, developed exclusively for the amusement and non-functional outside of that context. Examples of a fanciful device include, without limitation, the previously mentioned "magic wand" or a "ray gun" weapon. Furthermore, almost any detectable action can serve as a trigger. For example, emission and detection of light, pulling a lever, pressing a button, turning a key, opening a door, crossing a threshold, etc.). In some embodiments, rather than having a single trigger, a patron must complete a series of tasks (e.g., respond to questions, follow clues, physical feats, etc.) to trigger the lighting effect. In some embodiments, the triggered light show occurs at a later time and/or in a different location.

Furthermore, in some alternative embodiments, there is no pre-established viewing zone in which the lighting display is viewed. Rather, the MVAL system is able to determine the location at which the lighting display (or other lighting content) should be presented. In some such embodiments, the MVAL system includes a tracking-system sensor that tracks the location of a portable device (e.g., magic wand 968, etc.) that is used by a patron to attempt to trigger the lighting display. For example and without limitation, magic wand can be tracked by a camera, which transmits acquired images to image-recognition software. Alternatively, the wand broadcasts a beacon that is tracked by the MVAL system. In some additional embodiments, a tracking system is used to target the lighting effect to a particular patron. Tracking systems for tracking a patron include, without limitation, facial recognition software, blob tracking, and/or tracking of cellphones.

In some embodiments, an MVAL system is configured to interact with devices, such as a device owned by a third-party viewer, such as a patron/visitor. For example, in some embodiments, a smartphone application enables the third-party viewer, via his smartphone, to select custom lighting content (e.g., a lighting pattern, a lighting show, a message, etc.) for viewing. In some other embodiments, lighting content is a prize for completing an in-game task. To accomplish this, the MVAL system needs to know what lighting content to show to which viewing locations. More generally, when certain actions are taken with an electronic device (e.g., smartphone, tablet, computer, etc.), the device triggers the MVAL system to display lighting content in the region of the person that triggers the event. The location of the device can be determined, for example and without limitation, via RF locating systems, auditory locating systems, and/or visual locating systems.

It is notable that light pollution can be a concern for architectural lighting. With an MVAL system, light can easily be directed only to those locations where there are viewers. This prevents light pollution caused by reflections of light from areas where there are no viewers. In some embodiments, this is done statically, by predefining possible/likely viewing locations and lighting only those locations. In some other embodiments, a more sophisticated system is used to track the location of viewers and only light regions in which viewers are detected. A wide variety of sensing systems can be used for this purpose including, without limitation, motion detectors, pressure sensors, and/or camera-based sensors.

Figure 10:
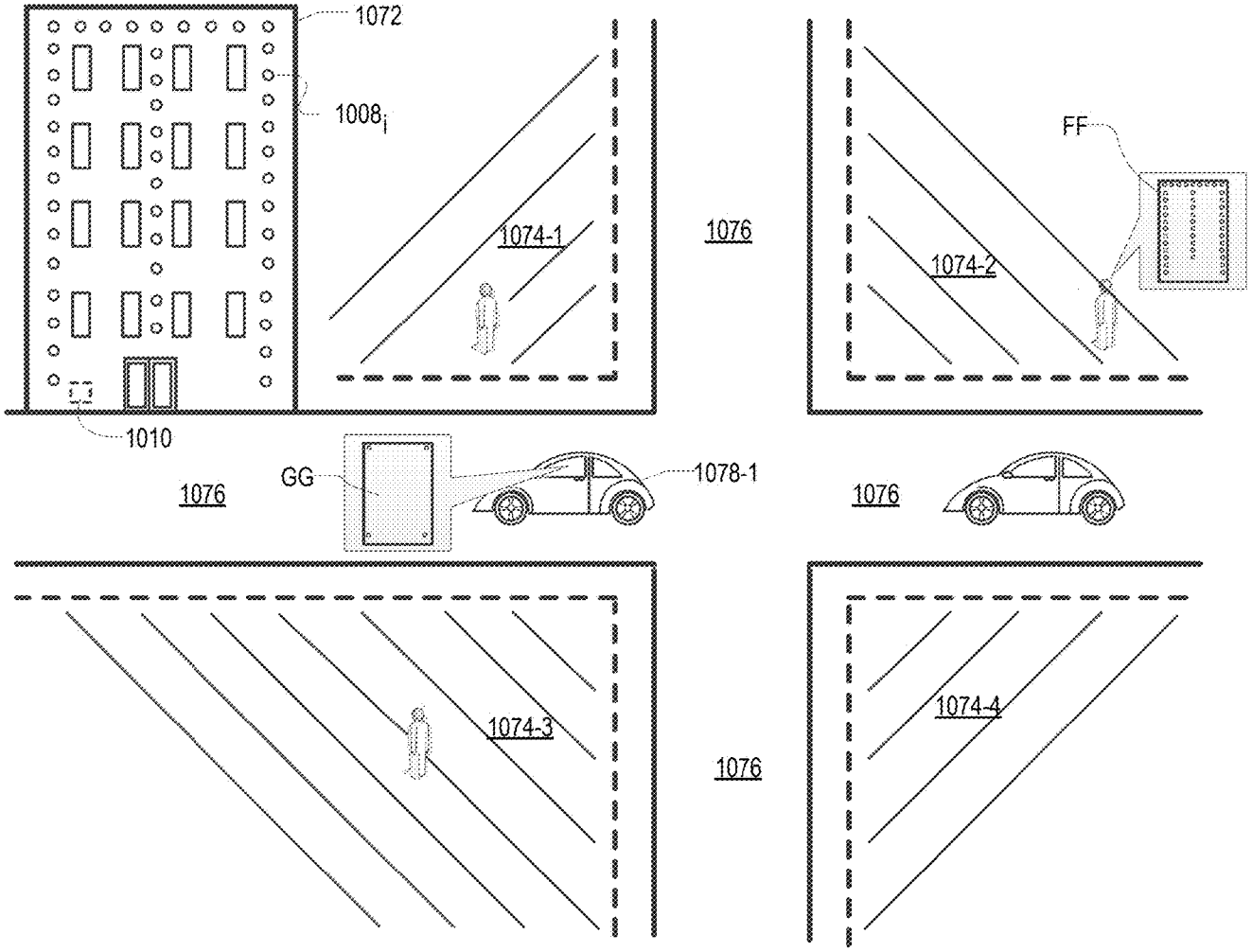
FIG. 10 depicts an embodiment wherein an MVAL system presents differentiated content to pedestrians in pedestrian areas and drivers of vehicles in roadways.

Many municipalities have restrictions on signs and lighting effects to avoid distracting drivers. In some embodiments, MVAL system provide complex and dynamic light shows in pedestrian areas, while simultaneously showing static lighting from a street (i.e., driver's) view. FIG. 10 depicts an example of this usage.

Building 1072 has MVAL system including controller 1010 and a plurality of MV lights 1008*i*. The MVAL system is operated such that viewing zones 1074-1, 1074-2, 1074-3, and 1074-4, which are pedestrian areas, see dynamic lighting content on building 1072. For example, a pedestrian in viewing zone 1074-2 sees all lights 1008 flashing different colors. Pedestrians in the other viewing zones 1074-1, 1074-3, and 1074-4 can see other dynamic lighting patterns (or the same pattern as seen in viewing zone 1074-2). Yet, at the same time, drivers in cars 1078, which are in viewing zones 1076, see a rather limited, non-distracting lighting display. For example, the driver of vehicle 1078-1 sees lighting pattern GG, wherein only four lights are lit, continuously, one at each corner of the front face of building 1072.

Figure 11:
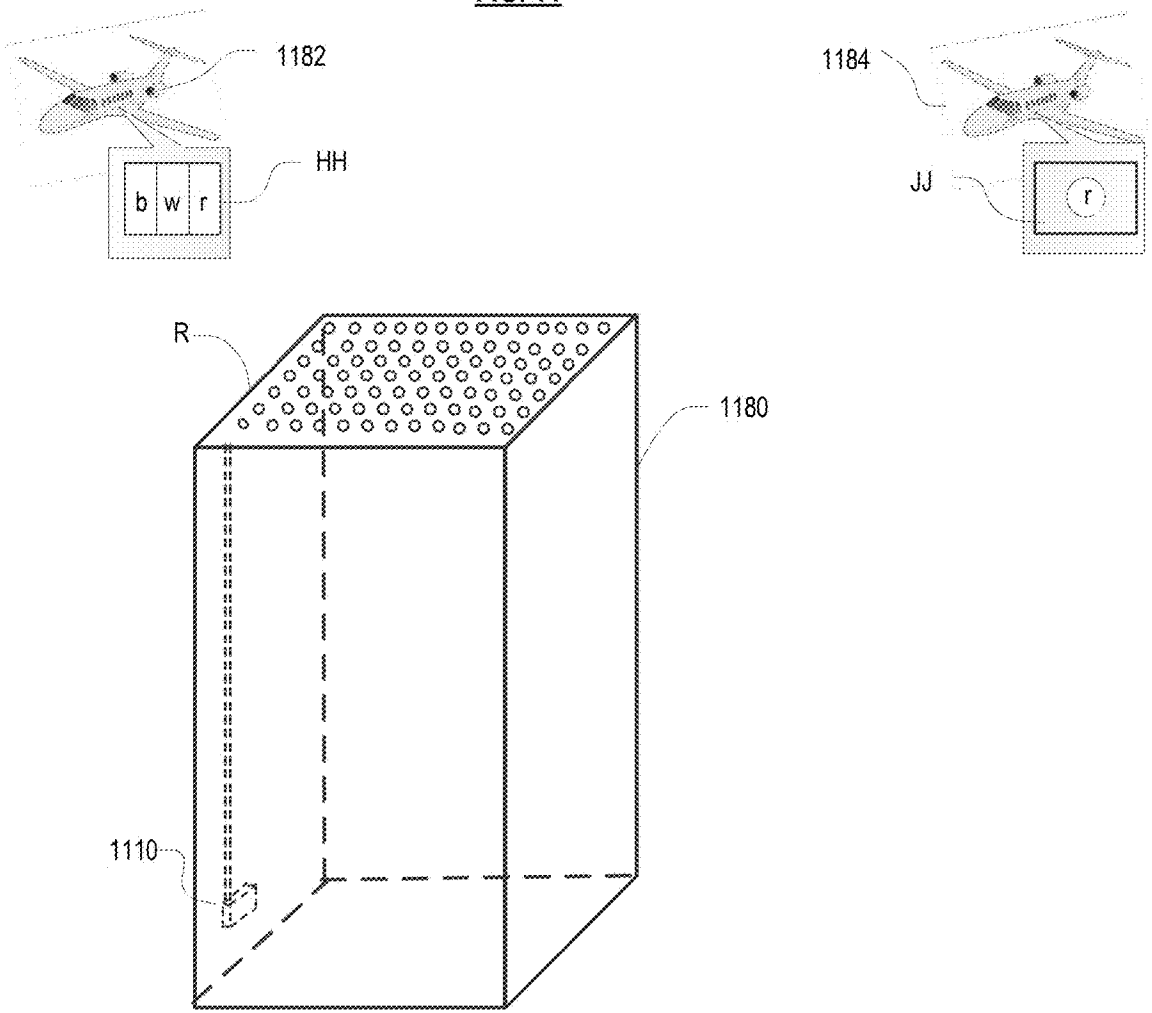
FIG. 11 depicts an embodiment wherein an MVAL system presents differentiated content to airplanes using real-time flight data.

For buildings that lie under a flight path, the roof of the building can exhibit lighting displays to be viewed from passing aircraft. In fact, with an MVAL system, different lighting presentations can simultaneously be shown to different aircraft. This can be accomplished, for example, using real-time flight data. For example and with reference now to FIG. 11, plane 1182 arriving from France can see, on roof R of building 1180, lighting display HH that simulates the flag of France, with its "b" blue, "w" white, and "r" red color fields. At the same time, passengers on plane 1184 arriving from Japan see lighting display II that simulates the Japanese flag, having "r" red circle in a white field. The two lighting presentations are simultaneously presented and passengers on plane 1182 will see only the French flag and passengers on plane 1184 will see only the Japanese flag. This is possible using the MVAL system since the planes will be in different regions in the sky; that is, they will be in different viewing zones. To accomplish this, the individual MV lights of the MVAL system can be precalibrated and pointing directions can be determined with a very small number of measurements. These can be done by briefly placing a calibration device, as previously disclosed, at known positions in front of the MV lights.

In another embodiment, an MVAL system is employed to illuminate the proper airport runaway for each approaching plane. Since each plane is at a different location in the sky, runaway illumination will be visible only to the aircraft for which it is intended. Although each plane's location is constantly changing, it is readily tracked and updated with the airport's tracking systems.

Projection mapping is becoming an increasingly popular lighting effect. Also referred to as "video mapping" and "spatial augmented reality," projection mapping uses a projection technology to turn objects, often irregularly shaped, into a display surface for video projection. These objects are commonly buildings or theatrical stages. Using specialized software, a two or three-dimensional object is spatially mapped on the virtual program that mimics the real environment it is to be projected on. The software interacts with a projector to fit any desired image onto the surface of the object. This technique enables a lighting designer, artist, etc., to add extra dimensions, optical illusions, and notions of movement onto what is a static object. By projecting directly onto a building, its appearance can be animated. For example, bricks might be made to appear as if moving in and out of the building face. Such an effect is implemented by projecting the appearance of the brick in different positions. However, in the prior art systems, the projection must presume a certain viewing perspective and it is only when viewed from the presumed perspective that the picture of the extended brick appears to be correct. When viewed from other viewing locations, the perspective will appear wrong.

In accordance with the present teachings, an MVAL system is used for projection mapping. The MVAL system overcomes the single-viewing-location problem that has until now plagued 3D projection mapping technologies because the MVAL system enables independent control over what is seen from different viewing locations.

For example, to create the illusion of a piece of a building extending out from the actual face thereof, an array of MV lights is used to outline the shape of the extended section as it would appear from different viewing locations. Thus, at a first instant in time, two viewers at two different positions observing an MVAL system both see a rectangular lighting pattern. However, in the next moment, one of the viewers perceives the rectangular illuminated lights moving "in" from her perspective, while simultaneously, the other of the viewers perceives them moving in from his perspective. In the two cases, the lighting pattern may be different to accommodate the two viewpoints, even though the resulting perception is similar.

In some embodiments, an MVAL system is used in conjunction with moving or mobile structures such as, without limitation, trucks, buses, parade floats, ships, and/or blimps. Motion is relative, and an MVAL system moving relative to a viewer can be treated as equivalent to a viewer moving relative to an MVAL system.

For designers of standard animated light shows on moving structures, the lighting show must be designed with the expectation that the show may come into view at any point during the animation. In accordance with an illustrative embodiment and unlike the prior art, using an MVAL system, a lighting show can be designed to proceed, such that as it passes a succession of viewing locations, the viewers located at the various viewing locations can see the light show proceed in the correct order from beginning to end.

Figure 12A:
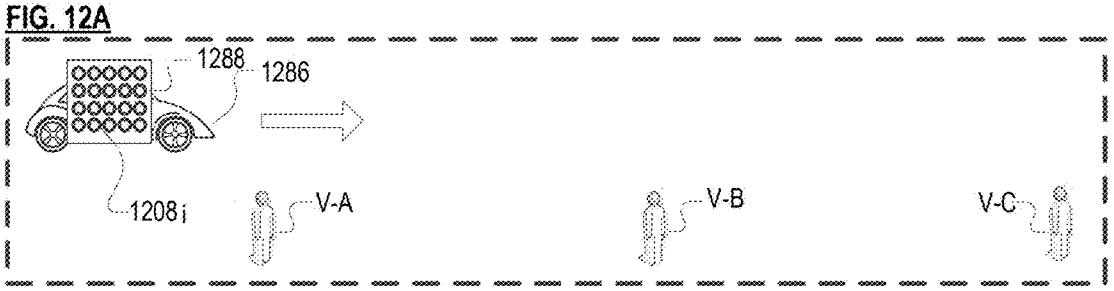
FIG. 12A-12C depict an embodiment of a moving MVAL system delivering differentiated sequenced content to different viewers.
Figure 12B:
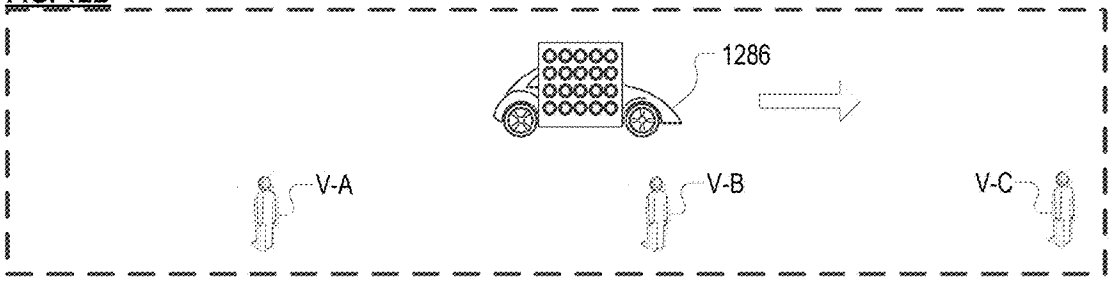
Figure 12C:
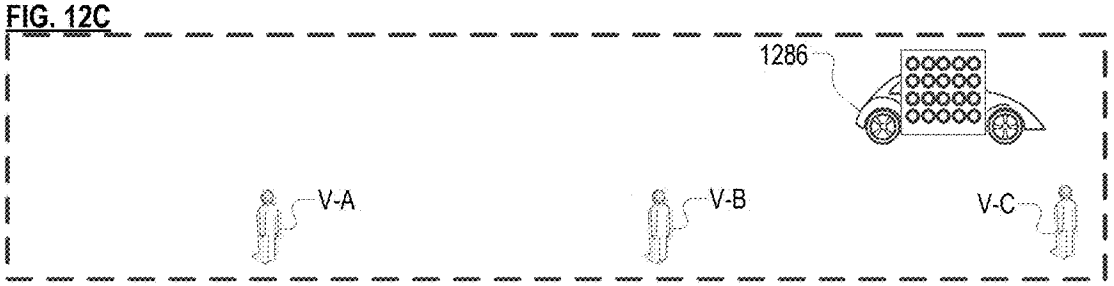

Referring now to FIGS. 12A-12C, MVAL system 1288 comprising a plurality of MV lights 1208; and a controller (not depicted) is coupled to a moving vehicle 1286. The MVAL system is moving past three spatially separated stationary viewers V-A through V-C. FIG. 12A depicts the MVAL system/vehicle at first time, FIG. 12B depicts the MVAL system/vehicle at a second time when it has moved toward viewer V-B, and FIG. 12C depicts the MVAL system/vehicle at a third time when it has moved toward viewer V-C.

In FIG. 12A, MVAL system 1288 is near to viewer V-A in a first viewing zone. Consequently, MV lights 1208 are controlled so that beginning light show content is directed toward viewer V-A while no light show content is viewable by viewers V-B and V-C. In FIG. 12B, MVAL system 1288 has moved towards viewer V-B in a second viewing zone. The MVAL system causes the MV lights 1208 to direct middle light show content to viewer V-A and beginning light show content to viewer V-B. In FIG. 12C, MVAL system 1288 has now moved towards viewer V-C in a third viewing zone. The MVAL system causes end light show content to be directed towards viewer V-A, middle light show content is directed towards viewer V-B, and beginning light show content is directed towards viewer V-C. Each viewer will therefore see the lighting show in the proper sequence as MVAL system 1288 proceeds.

In some embodiments in which vehicle 1286 moves at a known speed or speeds, and its position is known relative to the viewing zones, the MVAL system is triggered to direct lighting content to the viewing zones as a function of timing. That is, the controller can determine where, based on the speed of travel, vehicle 1286 is at any moment in time and causes the proper lighting content to display as a function of the determined position. In other embodiments, a sensor that senses the location of MVAL system 1288 is used to trigger the display of appropriate lighting content to the various viewing zones. Any of a variety of sensor arrangements can be used, including optical, RF, etc. It is notable that in some embodiments, appropriate lighting content is no lighting content.

In complex spaces, finding one's way to a specific location can be challenging. A variety of approaches have been developed to assist people to navigate such spaces. For example, hospitals frequently employ a system of lines painted different colors on the floor or walls: to reach the pharmacy, follow the yellow line; to go to the lab, follow the red line, and so forth. Unfortunately, when there are many destinations, the array of required colors gets large.

In a further embodiment, an MVAL system can be used to guide a person to an intended destination. In some embodiments, for example, a person requests guidance to a desired location at an appropriate interface. The MV lights of the MVAL system can light a path to the desired location, wherein the path is visible only to the requestor (by tracking the requestor). Based on their previously described functionality, the same MV lights can, at the same time, direct other people to different locations.

As indicated above, the request for directions is placed via a suitable interface, such as is available through a nearby kiosk, an App downloaded to the person's smart phone, or an attendant that takes the person's request and inputs it into the MVAL system, etc. As the request is being made, a tracking/sensing system acquires the information needed to track the requestor. For example, in some embodiments, the tracking/sensing system associates the person's smart phone with the request. In some other embodiments, the system acquires an image of the person and uses facial recognition software for tracking. In yet further embodiments, the person is given a transmitter. In some embodiments, each transmitter is identified with a particular destination and is pre-configured to transmit a code to the system that indicates the particular destination. Thus, as a person moves through the corridors, the transmitter transmits to the system and the system illuminates the appropriate MV lights to guide the holder of the transmitter to the pre-assigned destination. In some other embodiments, the transmitter is assigned a destination at the time it is acquired by the person.

Figure 13A:
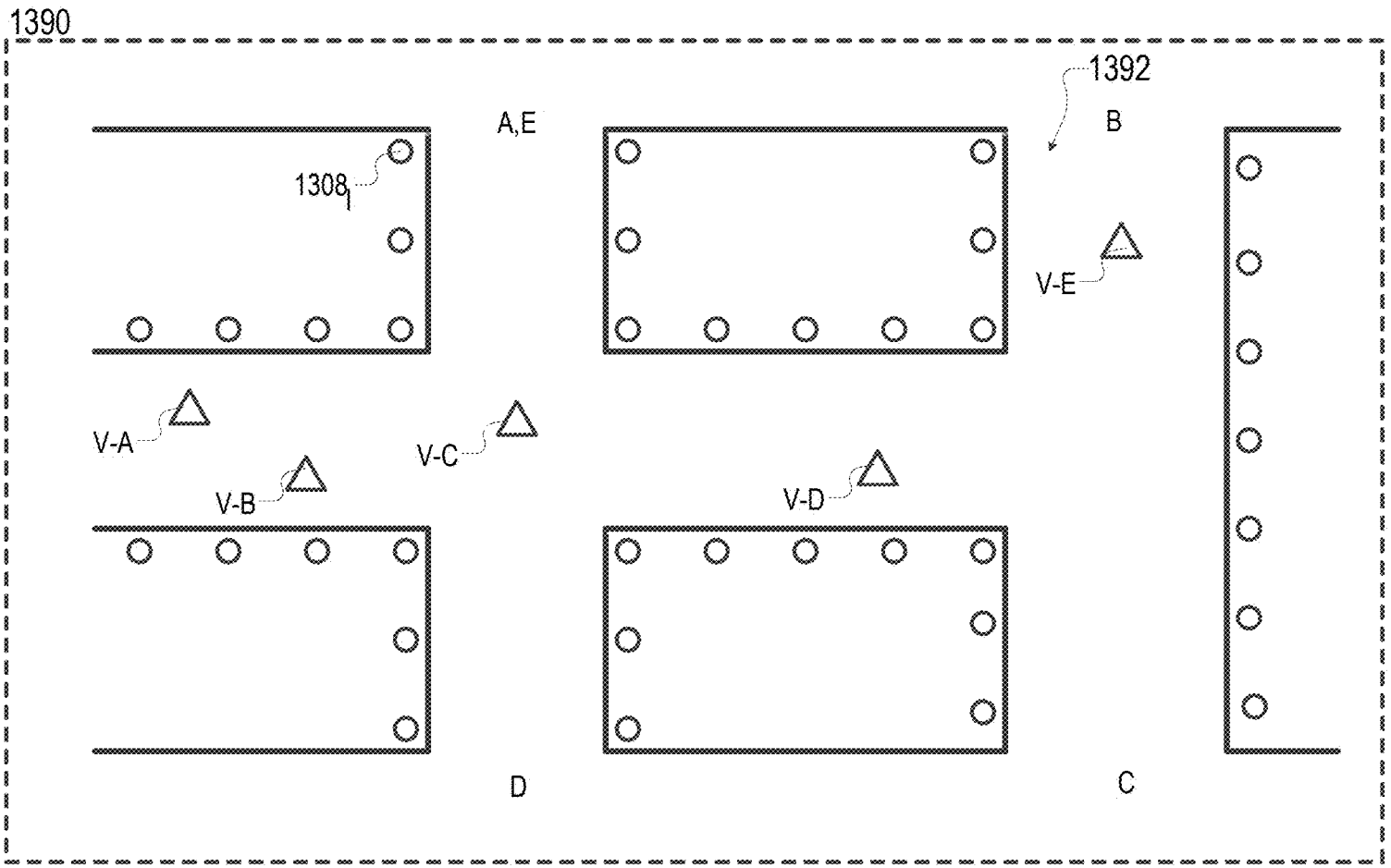
FIGS. 13A-13F depict an embodiment of an MVAL system for use in simultaneously assisting multiple people navigate to different destinations.
Figure 13B:
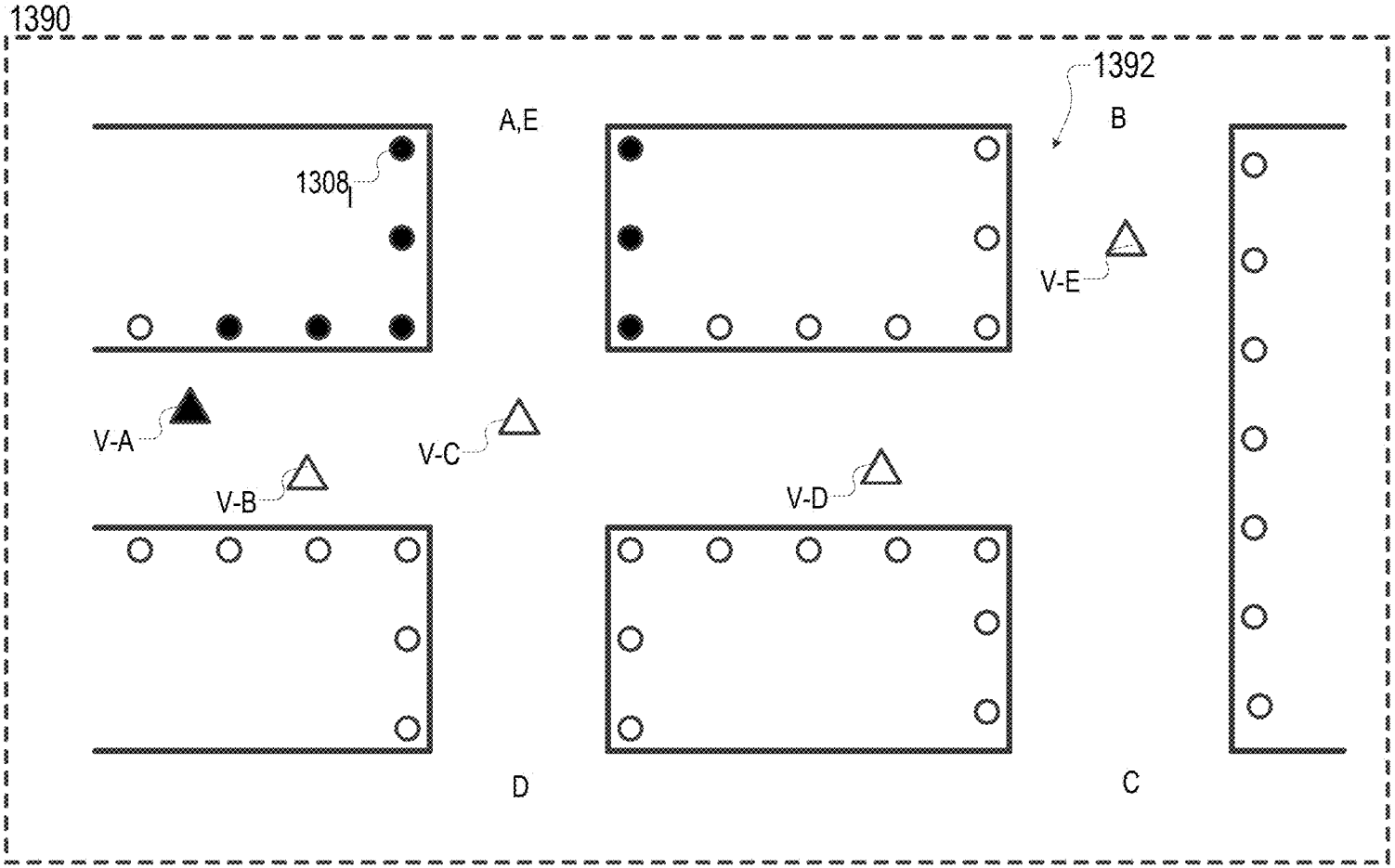
Figure 13C:
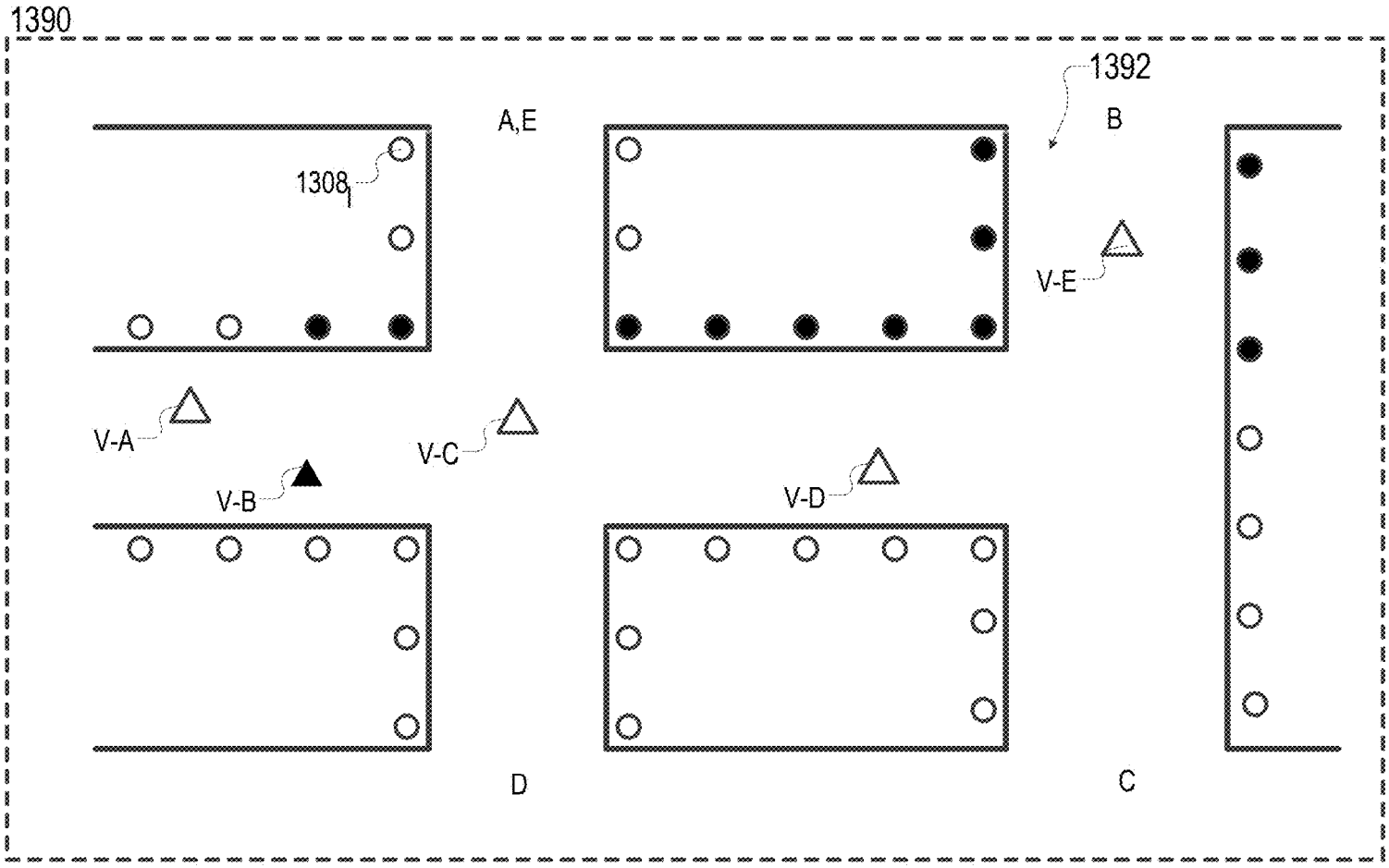
Figure 13D:
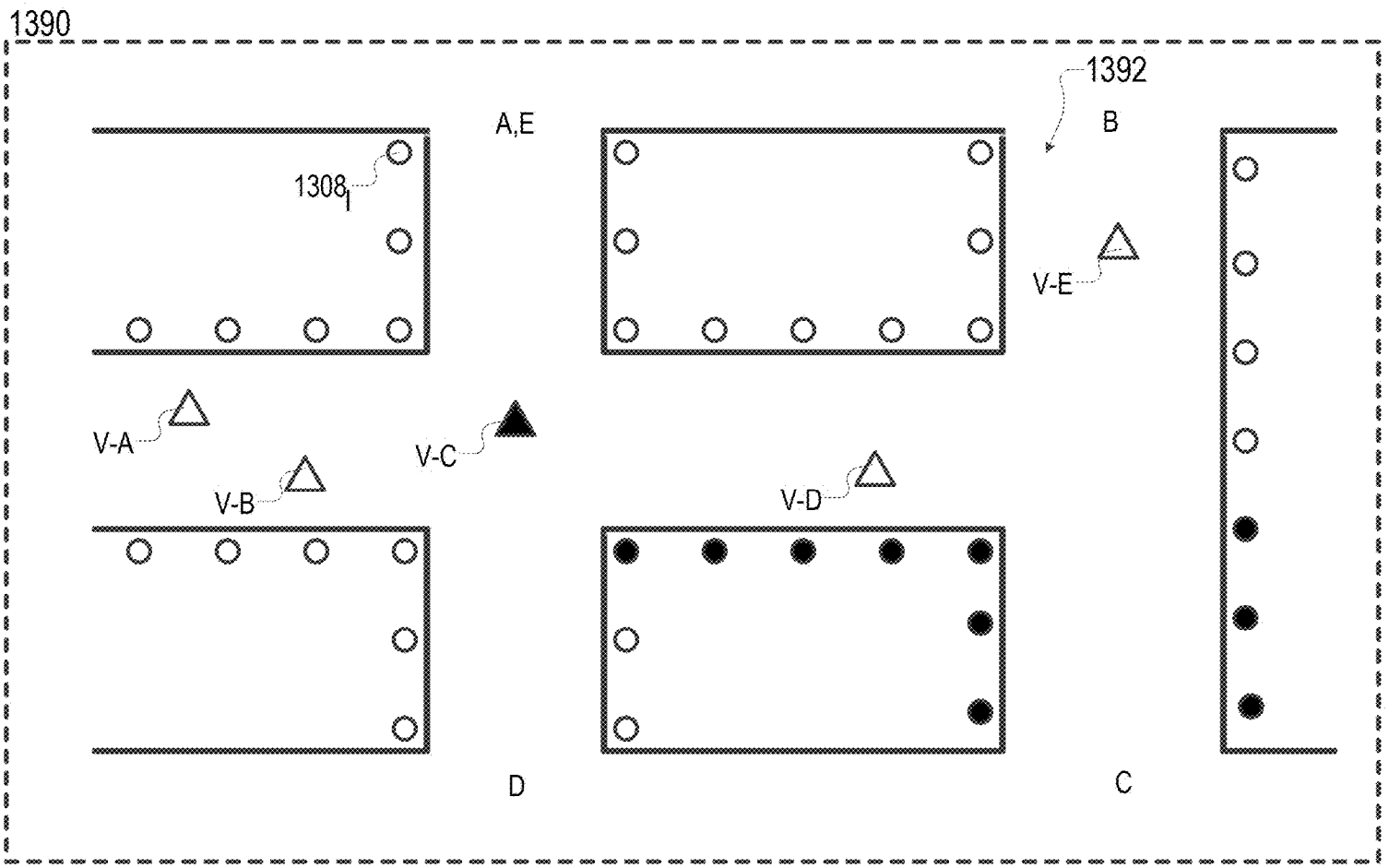
Figure 13E:
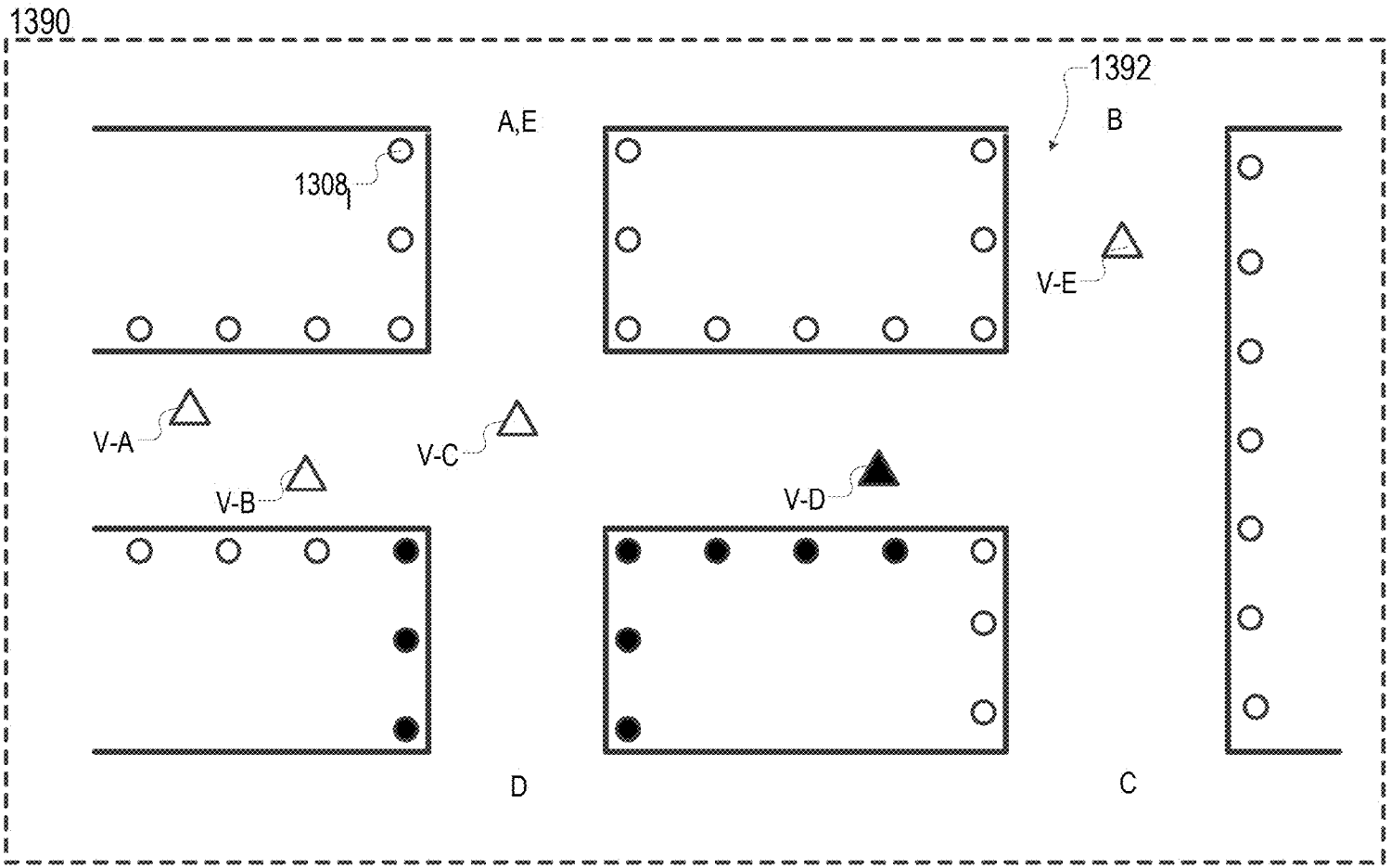
Figure 13F:
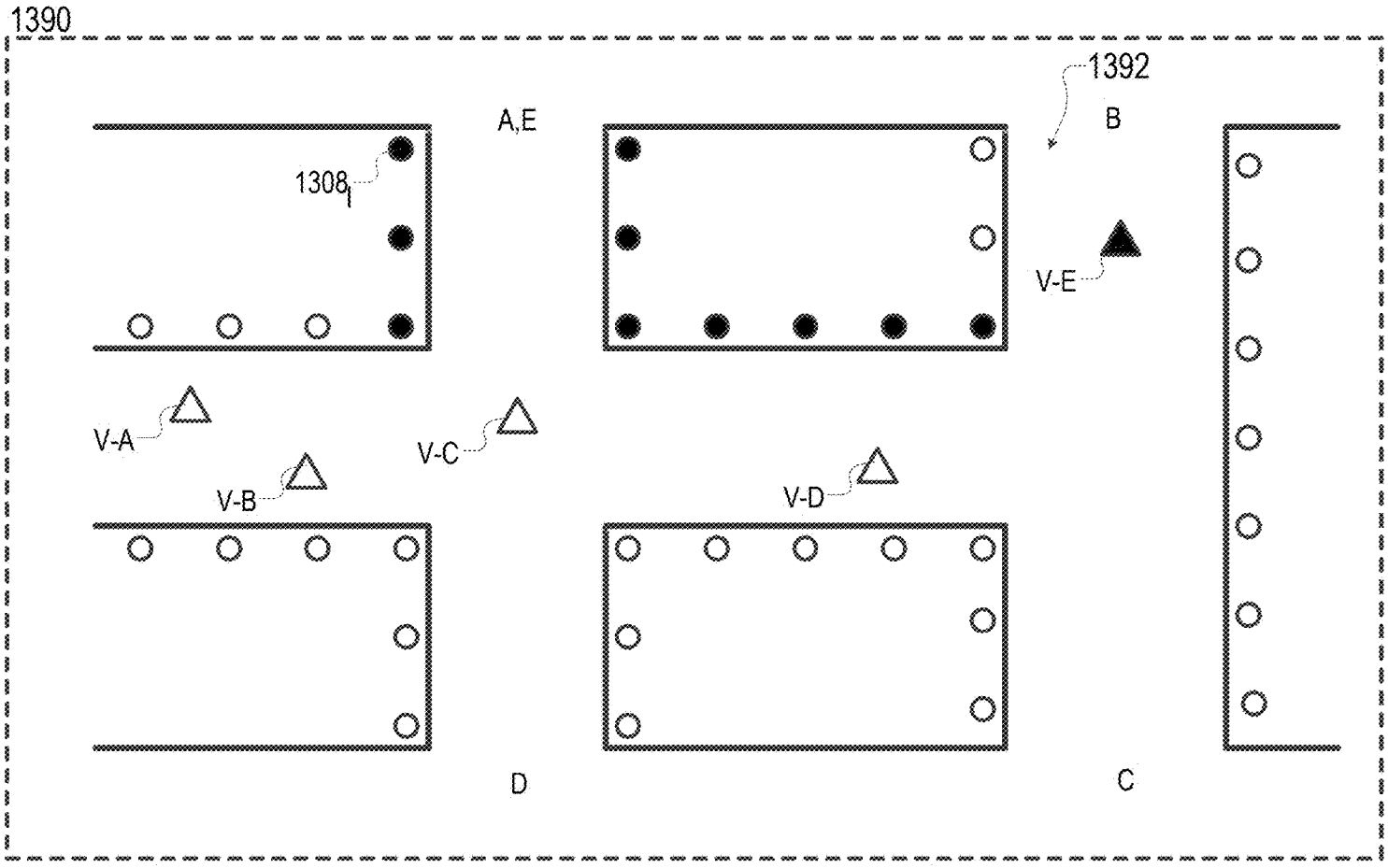

FIG. 13A depicts an embodiment wherein MVAL system 1392 is configured to help multiple people simultaneously navigate to different locations through portion 1390 of a building.

MVAL system 1392 includes a plurality of MV lights 1308; disposed in the walls of the corridors, a controller (not depicted), and a sensing/tracking system (not depicted) as described above. The MVAL system is configured to simultaneously illuminate different paths for different persons V-A, V-B, V-C, V-D, and V-E (based on their different viewing angles with respect to the MV lights) wishing to reach respective destinations A, B, C, D, and E. FIG. 13B through FIG. 13F depict the illumination perceived by respective viewers V-A, V-B, V-C, V-D, and V-E. Illuminated lights are appear to be "black" in the Figures.

The terms appearing below and inflected forms thereof are defined for use in this disclosure and the appended claims as follows:

The term "architectural lighting" refers generally to lighting on the outside of buildings, bridges, and other structures that is meant to do more than simply "illuminate." That is, such lighting serves both functional and aesthetic purposes. Furthermore, as used herein, the term "architectural lighting" extends to lighting that is installed on the exterior of a vehicle (e.g., car, train, etc.) wherein the lighting is not for the purpose of illuminating the road (headlights) or making the vehicle noticeable to others (tail lights), but rather is intended to provide content, either in the form of a lighting show or information. Moreover, the term architectural lighting applies to indoor lighting that is intended for a purpose other than simple illumination.

A "beamlet" is defined as an elemental entity of light emitted by an MV light. An MV light emits plural beamlets, each of which having an emission direction different from that of other beamlets emitted from the MV light. At least some of the beamlets are controllable independently of other beamlets emitted by the MV light. For example, and without limitation, in some embodiments, the light intensity and/or color of an individual beamlet is controllable independently of the intensity and/or color of the light of other beamlets emitted from the same MV light. By virtue of the foregoing, an MV light can controlled to emit light in certain directions but not others; or to independently adjust the brightness or color of light emitted in different directions. Other parameters of emitted light can also be adjusted independently for different directions of emission. Other parameters of beamlet light might also be controlled, such other parameters comprise, for example, spectral composition, polarization, beamlet shape, beamlet profile, overlap with other beamlets, focus, spatial coherence, temporal coherence, etc., to name just a few. It is notable that the word "beamlet" does not appear in standard dictionaries and has no accepted meaning in the industry.

A "fanciful device" is a device that does not exist or function apart from its use in conjunction with an MVAL system. One example is a "magic wand" that a viewer of the lighting system aims or waves to trigger a response from an MVAL system.

A "lighting pattern" or "lighting display" refers to a pattern/arrangement of light perceived by a viewer. The pattern is determined by which MV lights of an MVAL system appear to the viewer to be lit, as a function of the viewer's viewing location with respect to the MV lights, and is further determined by the intensity, color, and/or other characteristics of the light emitted by the MV lights to the viewer's viewing location.

"Lighting content" refers to one or more lighting patterns, lighting shows, or information (in the form of words, numbers, symbols, etc.) provided via MV lights.

A "lighting plan" refers to the locations on a structure, etc., where MV lights are intended to be placed so that, when the MVAL system is active, various lighting displays can be presented to various viewing zones.

A "multi-view pixel" is a more flexible version of the type of pixel used in conventional (non-multi-view displays). The light from a conventional pixel propagates in all directions, such that all viewers perceive the pixels essentially the same way, regardless of viewer position A multi-view pixel, however, can control the spatial distribution (emission direction) of light. In particular, a multi-view pixel can be commanded, for example, to emit light in certain directions but not others. Furthermore, it can be commanded to independently adjust the brightness of light emitted in different directions. Other parameters of emitted light can also be adjusted independently for different directions of emission.

A "third party viewer" is a viewer of an MVAL system who does not own/lease the structure on which the MVAL system is installed, is not involved in the design or maintenance of the MVAL system, is not an owner/operator of a facility in which the MVAL system is used (e.g., a theme park, etc.), and is not involved in the daily operation of the MVAL (other than, in some embodiments, to have a limited amount of control over the operation of the MVAL system via an App, etc., that is provided for the express purpose of enabling a third party viewer to briefly trigger a lighting display or have a limited amount of control over the lighting content presented during such brief system control).

A "viewing region" of an MVAL system refers to the range of possible positions/locations from which viewers of the lighting system can experience the MVAL system functionality. In particular, the MV lights of the MVAL system can emit beamlets in a range of possible directions. A viewer must be within that range in order to see at least one beamlet. For a viewer to see a full lighting pattern (e.g., as presented on a building), the viewer must be within the beamlet range of all MV lights responsible for creating that pattern. The viewing region is the collection of all positions where this requirement is met.

A "viewing zone" is typically a subset of a viewing region; that is, there are typically plural viewing zones in a viewing region. Based on a different viewing angle(s) in different viewing zones, different lighting content can simultaneously be presented to different viewing zones.

It is to be understood that this disclosure teaches just one or more examples of one or more illustrative embodiments, and that many variations of the invention can easily be devised by those skilled in the art after reading this disclosure, and that the scope of the present invention is defined by the claims accompanying this disclosure.

What is claimed:

1. A multi-view architectural lighting system comprising:

a controller; and a plurality of multi-view lights that are controlled by the controller, wherein:

(A) each multi-view light consists of a single multi-view pixel, wherein the multi-view pixel is capable of generating a plurality of beamlets, each of which has a different emission direction from other of the beamlets of the plurality;

(B) a placement of each multi-view light with respect to a placement of each other multi-view light is not constrained to a plane or otherwise limited;

(C) at least some beamlets of the plurality thereof are selectively generated and emitted under the control of the controller so that, simultaneously and from the same plurality of multi-view lights:

(i) a first lighting pattern generated by at least some of the selectively generated beamlets is perceivable at a first viewing zone of a viewing region;

(ii) one of either:

(a) a second lighting pattern generated by at least some other of the selectively generated beamlets is perceivable at a second viewing zone of the viewing region; or (b) no lighting pattern is perceivable at the second viewing zone because beamlets having an emission direction for causing a lighting pattern to be perceivable in the second viewing zone are not generated;

(iii) the first viewing zone and the second viewing zone have a different viewing angle from one another with respect to the multi-view lights; and (iv) the second lighting pattern is not perceivable at the first viewing zone and the first lighting pattern is not perceivable at the second viewing zone.

2. The lighting system of claim 1 and further comprising a triggering device, wherein the triggering device, when triggered, causes the lighting system to display the first lighting pattern.

3. The lighting system of claim 2 wherein triggering device causes the controller to display the first lighting pattern to a third viewing zone.

4. The lighting system of claim 2 wherein the controller is configurable to delay the display of the first lighting pattern, after triggering, for a period of time.

5. The lighting system of claim 2 and further comprising a tracking system, wherein the tracking system tracks a location of the triggering device and wherein the location of the triggering device defines the first viewing zone.

6. The lighting system of claim 2 wherein the triggering device is a fanciful device that has no function other than to interact with the lighting system.

7. The lighting system of claim 1 and further comprising a calibration system for calibrating the lighting system.

8. The lighting system of claim 1 and further comprising a table, accessible to the controller and stored in a processor-accessible storage device, which lists the emission direction of each beamlet from each MV light with respect to a pointing direction of each said MV light.

9. The lighting system of claim 1 and further comprising calibration data accessible to the controller and stored in a processor-accessible storage device, wherein the calibration data enables calculation of the emission direction of each beamlet from each MV light with respect to a pointing direction of each said MV light.

10. The lighting system of claim 1 and further comprising a table, accessible to the controller and stored in a processor-accessible storage device, which lists the emission direction of each beamlet from each MV light with respect to the first viewing zone and the second viewing zone.

11. The lighting system of claim 1 and further comprising calibration data accessible to the controller and stored in a processor-accessible storage device, wherein the calibration data enables calculation of the emission direction of each beamlet from each MV light with respect to the first viewing zone and the second viewing zone.

12. The lighting system of claim 1 and further comprising a user interface for selecting the first lighting pattern and the second lighting pattern from a plurality of lighting patterns that are displayable by the lighting system.

13. The lighting system of claim 12 and further wherein, via the user interface, the first lighting pattern is designated to be viewable at the first viewing zone and the second lighting pattern is designated to be viewable at the second viewing zone.

14. The lighting system of claim 13 wherein the input comprises a lighting pattern that is to be displayed to the third-party viewer.

15. The lighting system of claim 1 wherein the controller is configured to receive input sourced from a third-party viewer of the lighting system via a smart phone App.

16. The lighting system of claim 1 wherein the lighting system is configured to respond to actions performed on a personal electronic device of the third party viewer, wherein the device triggers the lighting system to display lighting content to a location of the third-party viewer.

17. The lighting system of claim 1 wherein the lighting system is configured so that it does not display the first lighting pattern to the first viewing zone when viewers are not present in the first viewing zone.

18. The lighting system of claim 1 wherein the lighting system is installed on a structure selected from the group consisting of a building, attractions in a theme park, a movie marque, theatrical stages, and vehicles.

19. A method for using architectural lighting, wherein the method comprises:

positioning a plurality of multi-view lights in arbitrary locations in 3D space with respect to one another as a function of a structure on which the multi-view lights are installed and in accordance with a lighting plan; and simultaneously selectively generating and emitting beamlets from at least some of the multi-view lights, so that:

(i) a first lighting pattern generated by at least some of the selectively generated beamlets is perceivable at a first viewing zone of a viewing region;

(ii) one of either:

(a) a second lighting pattern generated by at least some other of the selectively generated beamlets is perceivable at a second viewing zone of the viewing region; or (b) no lighting pattern is perceivable at the second viewing zone because beamlets having an emission direction for causing a lighting pattern to be perceivable in the second viewing zone are not generated;

(iii) the first lighting pattern, the second lighting pattern, and said no lighting pattern are generated by the same multi-view lights;

(iv) the first viewing zone and the second viewing zone have a different viewing angle from one another with respect to the multi-view lights; and (v) the second lighting pattern is not perceivable at the first viewing zone and the first lighting pattern is not perceivable at the second viewing zone.

20. The method of claim 19 and further comprising triggering a triggering device to cause the lighting system to display the first lighting pattern.

21. The method of claim 20 and further comprising displaying the first lighting pattern at a third viewing zone when triggered.

22. The method of claim 20 and further comprising delaying the display of the first lighting pattern for a period of time after the triggering device is triggered.

23. The method of claim 20 wherein a portion of the triggering device is mobile, and further comprising:

tracking a location of the portion that is mobile, and designating the location of the portion that is mobile as at least a part of the first viewing zone.

24. The method of claim 20 wherein triggering the triggering device further comprises sensing a movement of a fanciful device.

25. The method of claim 20 wherein triggering the triggering device further comprises receiving a signal from a fanciful device.

26. The method of claim 19 further comprising:

receiving a signal from an electronic device of a third-party viewer, and causing the lighting system to display lighting content, based on the received signal, to a location of the third-party viewer.

* * * * *